US007275620B1

(12) United States Patent
Diedrich et al.

(10) Patent No.: US 7,275,620 B1
(45) Date of Patent: Oct. 2, 2007

(54) SQUARE SPEAKER

(75) Inventors: Brad Michael Diedrich, Monroe, WI (US); Chad A. Kautz, Winslow, IL (US); Daniel Frank Roemer, Oregon, WI (US)

(73) Assignee: Mitek Corp., Inc., Monroe, WI (US)

( * ) Notice: Subject to any disclaimer, the term of this patent is extended or adjusted under 35 U.S.C. 154(b) by 0 days.

(21) Appl. No.: 11/779,980

(22) Filed: Jul. 19, 2007

(51) Int. Cl.
*G10K 13/00* (2006.01)
*H04R 7/20* (2006.01)

(52) U.S. Cl. ..... 181/171; 181/172; 181/173; 181/174

(58) Field of Classification Search ..... 181/171, 181/172, 173, 174
See application file for complete search history.

(56) References Cited

U.S. PATENT DOCUMENTS

| | | | | |
|---|---|---|---|---|
| 1,732,351 | A | 10/1929 | Borkman | |
| 1,891,566 | A | 12/1932 | McKellip | |
| 2,439,665 | A | 4/1948 | Marquis | |
| 2,442,791 | A | 6/1948 | Wente | |
| 2,997,549 | A * | 8/1961 | Hassan | 381/404 |
| 2,998,496 | A | 8/1961 | Hassan | |
| 3,026,958 | A | 3/1962 | Haerther | |
| 3,130,811 | A | 4/1964 | Petrie | |
| 3,268,672 | A * | 8/1966 | Roesel, Jr. et al. | 381/186 |
| 3,563,337 | A | 2/1971 | Kawamura | |
| 3,602,499 | A * | 8/1971 | Kojima | 472/60 |
| 4,239,943 | A * | 12/1980 | Czerwinski | 381/404 |
| 4,257,325 | A | 3/1981 | Bertagni | |
| 4,321,434 | A | 3/1982 | Irie | |
| 4,928,312 | A * | 5/1990 | Hill | 381/424 |
| 5,371,805 | A | 12/1994 | Saiki et al. | |
| 6,607,051 | B1 | 8/2003 | Peng | |
| 6,611,604 | B1 | 8/2003 | Irby | |
| 6,725,967 | B2 | 4/2004 | Hlibowicki | |
| 6,889,796 | B2 | 5/2005 | Pocock et al. | |
| 6,895,097 | B2 | 5/2005 | Furuyama | |
| 6,957,714 | B2 | 10/2005 | Takahashi et al. | |
| 7,054,459 | B2 | 5/2006 | Kuze et al. | |

(Continued)

OTHER PUBLICATIONS http://www.audio-warehouse.com/web/mdl/06S12L72/detail.asp Web page of Audio Warehouse Express downloaded Jul. 15, 2007, showing Kicker L7 12" speaker. A copy is included with references.

*Primary Examiner*—Lincoln Donovan
*Assistant Examiner*—Jeremy Luks
(74) *Attorney, Agent, or Firm*—Keith L. Jenkins, LLC; Keith L. Jenkins

(57) ABSTRACT

A square speaker is disclosed having a novel surround with a novel rounded corner design and with a magnet assembly and former sized, shaped, and arranged to exploit the increased excursions enabled by the novel surround. The arcuate portion of the rounded corner features smoothed trapezoidal circumferential undulations of the radially outer portion and an extension pad forms the arcuate portion of the radially inner portion of the rounded corner. An apex groove separates the inner portion from the outer portion. Tapered protrusions of the outer portion flank the smoothed trapezoidal circumferential undulations. The rounded corner is bounded by edges making angles of between 20 degrees and 40 degrees (preferably about 35 degrees) with straight sides of the square surround. Most of the outer perimeter of the entire inner flange adjoins the inner portions of the rounded corners. Significant increases in volume displacement per speaker size are achieved.

20 Claims, 13 Drawing Sheets

U.S. PATENT DOCUMENTS 7,174,990 B2 2/2007 Stead
7,218,748 B1 5/2007 Stompler
2005/0180588 A1 8/2005 Opitz
2007/0116304 A1* 5/2007 Hall et al. ..... 381/152

* cited by examiner (FIG. 3)
200
(FIG. 1)
100

SQUARE SPEAKER

FIELD OF THE INVENTION

The present invention relates to square loudspeakers in the low-frequency audible range (woofers and sub-woofers) having generally square diaphragms and surrounds. More particularly, the present invention relates to a square surround for a square woofer and a speaker design for exploiting the increased excursion capability of the novel square surround.

BACKGROUND OF THE INVENTION

A conventional loudspeaker, or "speaker", as used herein, may use a moveable diaphragm, or "speaker cone" to produce sound. Some speaker cones have radially symmetrical curvature, but may have shape variations (some are almost flat) that vary the geometry of the diaphragm from a strict geometric cone. The speaker cone is moved by a former, which also supports the voice coil. The former is attached to the speaker cone. The voice coil, which rests in the magnetic field of a magnet assembly, receives an audio-encoded electrical signal, or "audio signal", which causes varying current in the voice coil. By interaction of the voice coil current with the magnetic field of the magnet assembly, sound-producing movement of the former and speaker cone results. The voice coil is constrained to one-dimensional motion, perpendicular to the base plane of the speaker cone, by a flexible support structure called a "spider." The magnet assembly may comprise a magnetically permeable pole piece, a permanent magnet, and a magnetically permeable top plate. The pole piece may feature an annular groove, or "air gap," to permit motion of the voice coil deeper into the magnetic field of the magnet assembly. The speaker cone is supported at its widest perimeter by a flexible suspension, or "surround", which, in turn, is supported by a structure called a "basket." The top plate of the magnet assembly and the spider are also connected to the basket. An opening in the speaker cone at its center may be covered with a dust cap, which reduces the amount of dust that may affect voice coil motion in the annular groove. At least a portion of the surround conventionally has a semi-circular or sinusoidal transverse cross-section.

Square speakers, as the term is commercially used, fall into two categories. First, there are speakers that have square portions of the basket, especially the rim of the basket, and have round, usually circular, diaphragms and surrounds (U.S. Pat. No. 2,998,496 issued to Hassan on Aug. 29, 1961). Second, and of primary interest here, are square speakers that have square diaphragms and square surrounds, each with rounded corners. Hereinafter, the terms "square speaker," "square woofer" and the like, shall refer to speakers with square diaphragms and square surrounds, each with rounded corners. The advantage of a square speaker is that it may use the front area of a generally square or rectangular speaker cabinet with the greatest efficiency. Square speakers may produce more sound for a given area of cabinet front because the square diaphragm may take up more of the frontal area for a given size speaker. Additionally, square speakers may be arranged together with a minimum of wasted (non-diaphragm) space. Square speakers have been known for many years (U.S. Pat. No. 3,026,958 issued to Haerther, Jr. Mar. 27, 1962). The size of a square speaker is measured from side to side, just as with a round speaker.

The amount of sound produced by a speaker is proportional to the air volume displaced by the diaphragm in its axially oscillatory motion. The volume displacement, in turn, is determined as a function of the area of the plane of the diaphragm at its largest point and by the maximum distance it can travel from a quiescent state, called the speaker's "excursion." The designer must strike a balance between the size of the surround, enabling larger excursions if the surround is larger, and the area of the diaphragm, which gets smaller as the surround gets larger, for a given speaker size. A further difficulty with a larger surround is that, in motion, the surround also pushes air and, therefore, makes sound. Because the surround is constantly changing shape as the diaphragm moves, the sound produced by the surround is of lower quality than that created by the rigid diaphragm. Accordingly, the aim of speaker design is to find ways to maximize volume displacement while maintaining high sound quality.

For square speakers, attaining a larger diaphragm area with a highly flexible surround is complicated by the corner areas of the surround. If the surround is of uniform cross-sectional shape, the material of the surround deforms in non-uniform ways at the corners during use. The non-uniform deformation may cause unwanted loads on the diaphragm that degrade sound quality, may require a stronger (heavier) diaphragm and so may require more work to move it, or may introduce a side force that causes binding between the former and the pole piece.

On Aug. 26, 2003 Irby, et al. were awarded U.S. Pat. No. 6,611,604 (hereinafter "Irby") for an Ultra Low Frequency Transducer and Loudspeaker Comprising Same which disclosed pleats in the corners of a the surround of a square subwoofer. Irby's pleats are circumferential over the arch of the surround. Speakers manufactured similar to Irby are sold under the trade name KICKER. A particular ten-inch KICKER has a diaphragm area of 68 square inches and an excursion of one inch. Such a speaker has a ratio of volume displacement to speaker size of 13.6. Another particular twelve-inch KICKER has a diaphragm area of 100 square inches and an excursion of one inch. Such a speaker has a ratio of volume displacement to speaker size of 16.7.

The inventors have recognized a need for a square speaker with a larger displacement volume achieved at no loss to sound quality. The inventors have also recognized a need for a square speaker with higher ratios of volume displacement to speaker size (louder speakers). In order to meet those needs, and to solve related problems, the inventors have developed the novel square speaker of the present invention.

OBJECTS AND FEATURES OF THE INVENTION

A primary object and feature of the present invention is to provide a square speaker with a larger displacement volume and with a larger volume displacement-to-speaker-size ratio. It is a further object and feature of the present invention to provide such a speaker having a surround with improved corners. It is a further object of the invention to provide a square surround that permits larger excursions. It is yet another object of this invention to provide a surround that leaves room for a larger diaphragm. It is yet another object and feature of the present invention to provide such a surround with an integral gasket. It is still yet another object and feature of the present invention to provide such a square speaker designed to accommodate larger excursions of the diaphragm and former. A further primary object and feature of the present invention is to provide such a speaker that is efficient, inexpensive, and handy. Other objects and features of this invention will become apparent with reference to the following descriptions.

SUMMARY OF THE INVENTION

In accordance with a preferred embodiment hereof, this invention provides a square speaker with a square surround with a rounded corner having an arcuate portion having a radially inner portion having an arcuate transverse cross-section, a radially outer portion having an arcuate transverse cross-section, an apex defining a boundary there between, and circumferential undulations only on the outer portion.

Moreover, it provides such square surround in which the circumferential undulations comprise smoothed trapezoidal circumferential undulations. Additionally, it provides such square surround further comprising a straight side adjoining the rounded corner and a rounded corner having a tapered protrusion on the outer portion, wherein the tapered portion has an edge making an angle of between 20 degrees and 40 degrees with the proximal straight side. Additionally, it provides such square surround further comprising a straight side adjoining the rounded corner and a rounded corner having an extension pad forming the inner portion, wherein the extension pad has an edge making an angle of between 20 degrees and 40 degrees with the straight side. Also, the rounded corner has a groove along the apex thereof. Also, the square surround may have an integral gasket. Additionally, the square speaker has a magnet assembly and a former, and the magnet assembly is sized, shaped, and arranged to allow upward and downward excursions of the former, the excursions having a magnitude that exploits the flexibility of the square surround.

In accordance with another preferred embodiment hereof, this invention provides a square speaker having a rounded corner on a square surround, the rounded corner having an arcuate portion having a radially inner portion having an arcuate transverse cross-section, a radially outer portion having an arcuate transverse cross-section, an apex defining a boundary between the inner portion and the outer portion, and straight sides adjoining said rounded corner, the rounded corner further comprising an extension pad forming said inner portion, wherein the extension pad has edges making angles of between 20° and 40° with the straight sides.

Also, it provides such edges having angles between 35 degrees and 35.3 degrees. In addition, it provides an apex groove that bounds the extension pad. Additionally, the outer portion of the rounded corner has circumferential undulations. Further, such circumferential undulations are trapezoidal circumferential undulations. Yet further, such circumferential undulations are smoothed trapezoidal circumferential undulations. Yet even further, such circumferential undulations increase in amplitude with proximity to the apex groove. Even further, it provides such rounded corner having a tapered protrusion on the outer portion, the tapered protrusion having an edge making an angle of less than 40 degrees and greater than 20 degrees with a proximal straight side of the aforementioned straight sides. Additionally, it provides such a square speaker having a rim for receiving said square surround; a gasket for securing the square surround on the rim, wherein the gasket is integral to said square surround or discrete there from; a basket supporting the rim; a square diaphragm attached to the square surround; a sub-cone fixed to the underside of the square diaphragm; a former fixed to the sub-cone and supported by a spider that is supported by the basket, wherein the spider flexibly supports the former with the assistance of a collar; and a voice coil fixed to the former, wherein the voice coil is positioned in a magnetic field formed by a magnet assembly supported by the basket, wherein the magnet assembly is sized, shaped, and arranged to allow upward and downward excursions of the former exploitive of said square surround. Additionally, the square surround may have an integral gasket.

In accordance with another preferred embodiment hereof, this invention provides a square loudspeaker having a rounded corner on a square surround, said rounded corner having an arcuate portion having a radially inner portion and a radially outer portion; an apex defining a boundary between the inner portion and the outer portion; smoothed trapezoidal circumferential undulations of the outer portion, comprising a sequence of protrusions and depressions, wherein the undulations have an amplitude and the amplitude increases with proximity to an apex groove; a groove along the apex; a pair of tapered protrusions on the outer portion flanking the smoothed trapezoidal circumferential undulations; an extension pad forming the inner portion, wherein the extension pad extends radially outward increasingly with proximity to the apex groove; edges defining boundaries between the rounded corner and the straight sides of the square surround, wherein the edges make angles of between 20 degrees and 40 degrees with the proximal straight sides, the edges forming edges of the expansion pad and forming edges of the tapered protrusions.

Also, it provides such a square speaker having a rim for receiving the square surround; a gasket for securing the square surround on the rim, wherein the gasket is either integral to the square surround or discrete there from; a basket supporting the rim; a square diaphragm attached to the square surround; a sub-cone fixed to the underside of the square diaphragm; a former fixed to the sub-cone and flexibly supported by a spider that is supported by the basket, wherein the spider supports the former with the assistance of a collar; and a voice coil fixed to the former, wherein the voice coil is positioned in a magnetic field formed by a magnet assembly supported by the basket, wherein the magnet assembly is sized, shaped, and arranged to allow upward and downward excursions of the former exploitive of the square surround.

Additionally, the protrusions and the depressions of the smoothed trapezoidal circumferential undulations individually have unequal amplitudes.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figure 1:
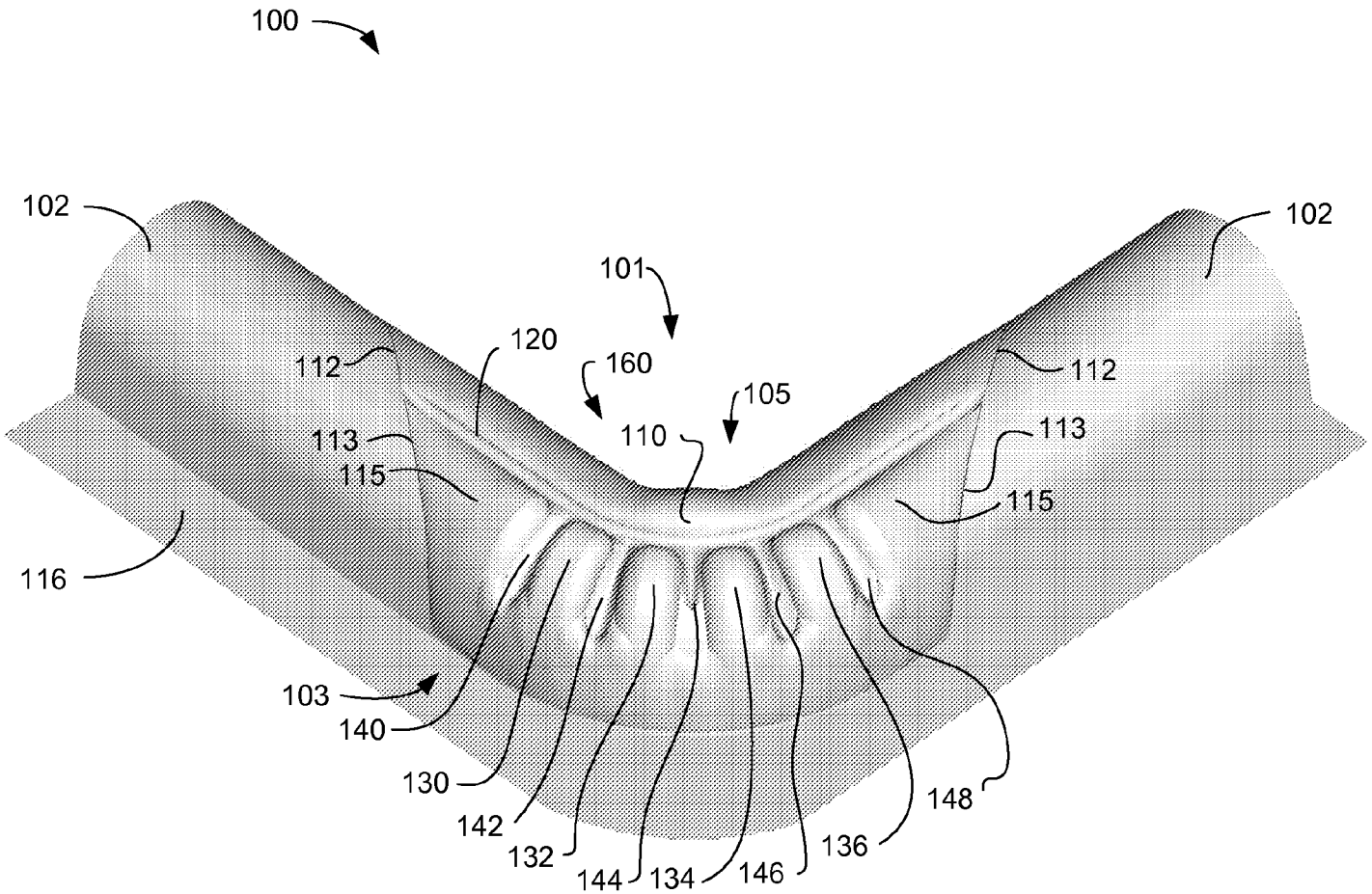
FIG. 1 shows a rendered perspective view illustrating a first exemplary embodiment of a rounded corner of a square surround viewed from the exterior of the square surround, according to a preferred embodiment of the present invention.

FIG. 1 shows a rendered perspective view illustrating a first exemplary embodiment of a rounded corner 101 of a square surround 100 viewed from the exterior of the square surround 100, according to a preferred embodiment of the present invention. The rounded corner 101 was developed using finite element analysis. The square surround 100 includes straight sides 102 having a continuously arcuate transverse cross-section. Straight sides 102 adjoin rounded corner 101. Square surround 100 is preferably made of a single piece of compression molded NBR of uniform thickness throughout. The continuously arcuate transverse cross-section of straight sides 102 may be considered as a baseline cross-section against which the features of rounded corner 101 may be compared and described. In a preferred embodiment, the continuously arcuate transverse cross-section of straight sides 102 is semi-circular. In various alternate embodiments, various cross-sections may be used. For example, in an alternate embodiment, a cross section including one or two straight, vertical base portions supporting a continuously arcuate top portion may be used. For further example, without limitation, in an alternate embodiment, the continuously arcuate transverse cross-section of straight sides 102 may be parabolic, elliptical, or hyperbolic.

The rounded corner 101 comprises an outer flange 116, an inner flange 107, and an arcuate portion 160 between. The arcuate portion 160 is divided into a radially inner portion 105 and a radially outer portion 103, relative to center of curvature of the rounded corner 101, by an apex groove 120 along the apex 1002 (see FIG. 10) of the arcuate portion 160 of square surround 100 in the rounded corner 101. The extent of rounded corner 101 is bounded by edges 112 and 113, over the substantially all of the arcuate portion of straight sides 102. The edges 112 and 113 are surface features: the material of the surround is continuous across the edges 112 and 113. The apex 1002 preferably follows the midline of the arcuate portion 160 of the rounded corner 101, as shown. In various alternate embodiments, the line of the apex 1002 may deviate. The radially outer portion 103 extends both outward and inward relative to the continuously arcuate transverse cross-section of straight sides 102 and is bounded by edges 113, apex groove 120, and outer flange 116. Radially outer portion 103 has an arcuate transverse cross section. Radially outer portion 103 is a variation of, and not an overlay upon, straight sides 102.

Radially outer portion 103 includes protrusions 130, 132, 134, and 136 that extend outwardly relative to the continuously arcuate transverse cross-section of straight sides 102 and which will be described in more detail below. Protrusions 130, 132, 134, and 136 are preferably symmetrically arranged relative to a radius of the rounded corner 101, as shown. Protrusions 130, 132, 134, and 136 are flanked by tapered protrusions 115, which decrease in their extension relative to the surface of proximal sides 102 until meeting such surface at edges 113. Tapered protrusions 115 and protrusions 130, 132, 134, and 136 are continuous with depressions 140, 142, 144, 146, and 148 that extend interior to the continuously arcuate transverse cross-section of straight sides 102. If the protrusions 130, 132, 134, and 136 and the depressions 140, 142, 144, 146, and 148 are considered as a whole, they form circumferential undulations 1202 (see FIG. 12A-B) of the outer portion 103. The radially inner portion 105 of rounded corner 101 includes extension pad 110, which forms inner portion 105 and extends radially outwardly relatively to the continuously arcuate transverse cross-section of straight sides 102. In an alternate embodiment, extension pad 110 may form less than all of the inner portion 105.

Figure 2:
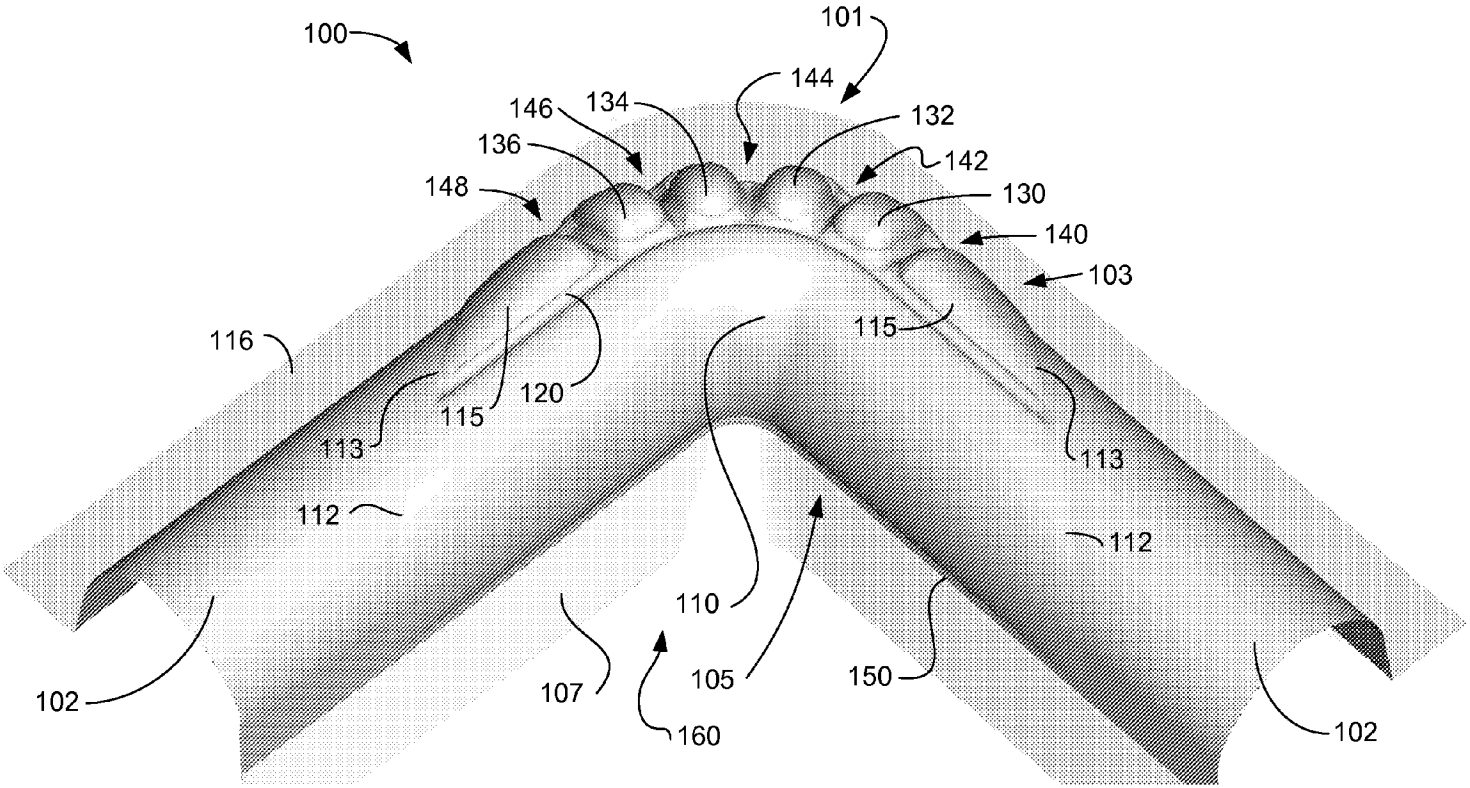
FIG. 2 shows a rendered perspective view illustrating the rounded corner of a square surround according to FIG. 1 viewed from the interior of the square, according to a preferred embodiment of the present invention.

FIG. 2 shows a rendered perspective view illustrating the rounded corner 101 of the square surround 100 according to FIG. 1 viewed from the interior of the square, according to a preferred embodiment of the present invention. Radially inner portion 105 is bounded by the outer boundary 150 of inner flange 107, edges 112, and apex groove 120. Radially inner portion 105 has an arcuate transverse cross section. Preferably, extension pad 110 forms inner portion 105, as shown. Edges 112 are preferably collinear with edges 113. Extension pad 110, regarded in transverse cross-section, preferably extends radially outwardly, relative to the continuously arcuate transverse cross-section of straight sides 102, with the extension increasing with proximity to the apex groove 120.

Figure 3:
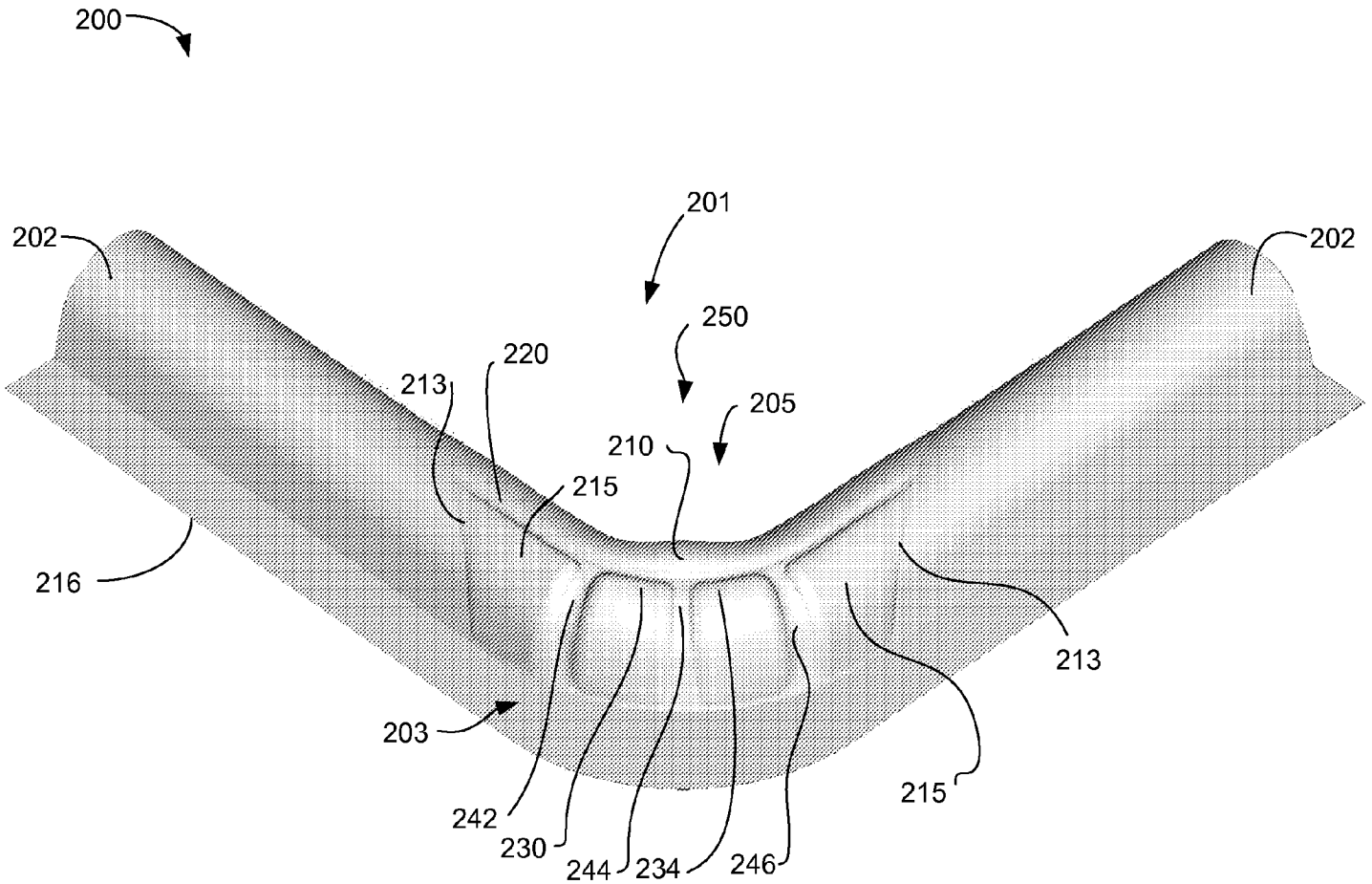
FIG. 3 shows a rendered perspective view illustrating a second exemplary embodiment of a rounded corner of a square surround viewed from the exterior of the square surround, according to a preferred embodiment of the present invention.

FIG. 3 shows a rendered perspective view illustrating a second exemplary embodiment of a rounded corner 201 of a square surround 200 viewed from the exterior of the square surround 200, according to a preferred embodiment of the present invention. The square surround 200 includes straight sides 202 having a continuously arcuate transverse cross-section. Straight sides 202 adjoin rounded corner 201. Square surround 200 is preferably made of a single piece of compression molded NBR of uniform thickness throughout. The continuously arcuate transverse cross-section of straight sides 202 may be considered as a baseline cross-section against which the features rounded corner 201 may be compared and described. In a preferred embodiment, the continuously arcuate transverse cross-section of straight sides 202 is semi-circular. In various alternate embodiments, various cross-sections may be used. For example, in an alternate embodiment, a cross section including one or two straight, vertical base portions supporting a continuously arcuate top portion may be used. For further example, in an alternate embodiment, the continuously arcuate transverse cross-section of straight sides 202 may be parabolic or elliptical.

The rounded corner 201 comprises an outer flange 216, an inner flange 207, and an arcuate portion 260 between. The arcuate portion 260 is divided into a radially inner portion 205 and a radially outer portion 203, relative to center of curvature of the rounded corner 201, by an apex groove 220 along the apex 1002 (see FIG. 10) of the arcuate portion 260 of square surround 200 in the rounded corner 201. The radially outer portion 203 extends both outward and inward relative to the continuously arcuate transverse cross-section of straight sides 202 and is bounded by edges 213, apex groove 220, and flange 216. Radially outer portion 203 is a variation of, and not an overlay upon, straight sides 202. Radially outer portion 203 includes protrusions 230 and 234 that extend outwardly relative to the continuously arcuate transverse cross-section of straight sides 202 and which will be described in more detail below. Protrusions 230 and 234 are preferably symmetrically arranged relative to a radius of the rounded corner 201, as shown. Protrusions 230 and 234 are flanked by tapered protrusions 215, which decrease in their extension relative to the continuously arcuate transverse cross-section of proximal sides 202 until meeting such cross-section at edges 213. Tapered protrusions 215 and protrusions 230 and 234 are continuous with depressions 242, 244, and 246 that extend inwardly relative to the continuously arcuate transverse cross-section of straight sides 202. Protrusions 215, 230, and 234 and depressions 242, 244, and 246, considered as a whole, form circumferential undulations 1402 (see FIGS. 14A-B) of the outer portion 203. The radially inner portion 205 of rounded corner 201 includes extension pad 210, which extends radially outwardly relatively to the continuously arcuate transverse cross-section of straight sides 202.

Figure 4:
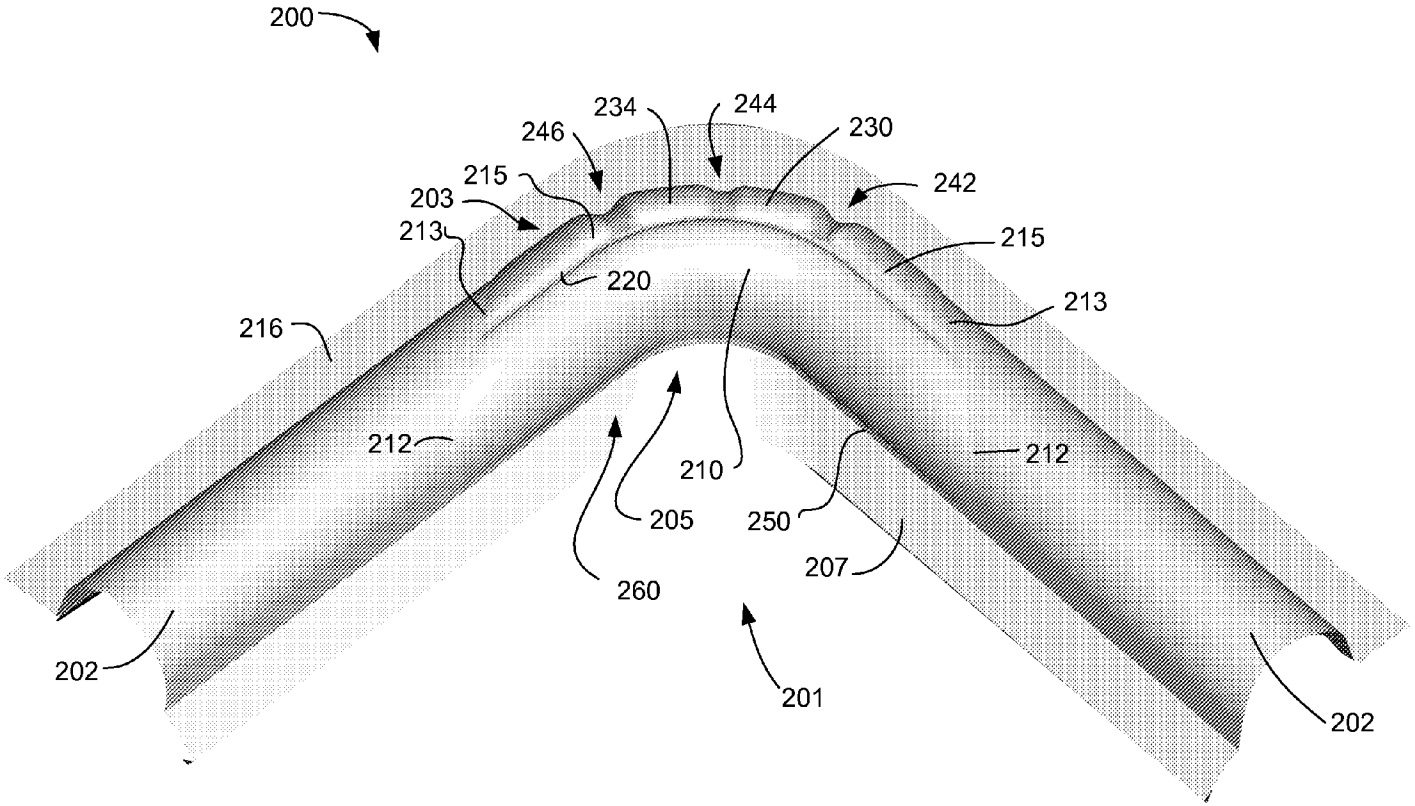
FIG. 4 shows a rendered perspective view illustrating the rounded corner of a square surround according to FIG. 3 viewed from the interior of the square, according to a preferred embodiment of the present invention.

FIG. 4 shows a rendered perspective view illustrating the rounded corner 201 of the square surround 200 according to FIG. 3 viewed from the interior of the square, according to a preferred embodiment of the present invention. Extension pad 210 is bounded by the outer boundary 250 of inner flange 207, edges 212, and apex groove 220. Edges 212 are preferably collinear with edges 213. Extension pad 210, regarded in cross-section, preferably extends outwardly, relative to the continuously arcuate transverse cross-section of straight sides 202, with the extension increasing with proximity to the apex groove 220.

Figure 5:
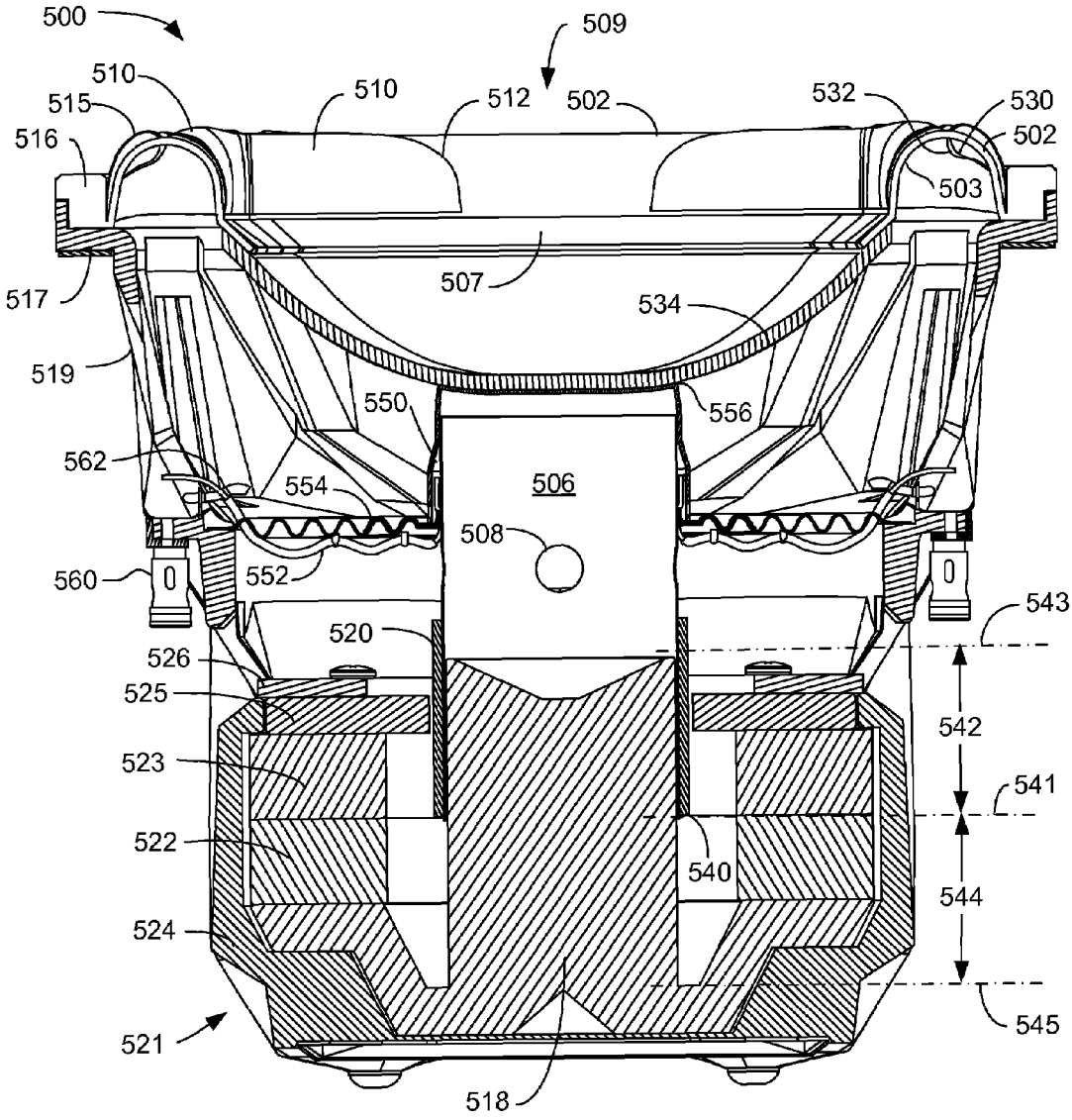
FIG. 5 shows a sectional elevation view illustrating an exemplary embodiment of a square speaker according to a preferred embodiment of the present invention.

FIG. 5 shows a sectional elevation view illustrating an exemplary embodiment of a square speaker 500 according to a preferred embodiment of the present invention. Square speaker 500 includes basket 519 that provides basic structural support for other parts of square speaker 500. Basket 519 supports rim 517, which receives and supports square surround 509. Square surround 509 is similar to square surround 100 of FIG. 1 with the additional of integral gasket 516. The continuously arcuate transverse cross section 503 of straight side 502 of surround 509 is illustrated near the upper left corner of FIG. 5. Depressions 530 and 532 intrude interior to the cross section 503. Near the upper right corner of FIG. 5, the tapered protrusion 515 and the protrusion of extension pad 510 are illustrated. Because of the curved surface of straight side 502, edge 512 appears curved in this view.

Surround 509 also includes inner flange 507, which adheres to diaphragm 534. Preferably, an extra bead of glue assists in adhering the outer edge of diaphragm 534 to inner flange 507. Surround 509 flexes in response to the axial (up and down, in this view) movement of diaphragm 534. Preferably, diaphragm 534 is a three-part laminate, including a 0.5 millimeter thick aluminum top, a three millimeter thick Rohacell 71LS PMI middle, and a 0.5 millimeter glass fiber bottom. The underside of diaphragm 534 is coupled to sub-cone 556, which is coupled to former 506. Preferably, sub-cone 556 is made of glass fiber, which provides a good materials match for the glass fiber bottom of diaphragm 534. Former 506 has vents, such as vent 508, distributed about its circumference. A collar 550 is formed in the lower extremity of sub-cone 556, and is preferably made of spun-laced Nomex. Collar 550 secures the inner perimeter of spider 554 and the inner end of tinsel 552 to the former 506. The spider 554 flexibly supports former 506. Preferably, the inner perimeter of spider 554 is secured in collar 550 with epoxy both above and below the point of attachment. The outer perimeter of spider 554 is coupled to basket 519, preferably with epoxy above and below the spider 554. The spider 554 is preferably made of Nomex and poly-cotton. In various alternate embodiments, other materials having similar flexibility, resilience, strength, and thermal properties may be used. Tinsel 552, which is the signal conduit for the audio signal, is coupled to spider 554. In an alternate preferred embodiment, tinsel 552 may be integral to spider 554. Strain relief 562 for tinsel 552 assists in isolating the affects of any outside forces on the audio signal wire from the tinsel 552.

Former 506 is fixed to the voice coil 520, which receives the audio signal from an external amplifier into terminal 560 and through the tinsel 552. At its quiescent state, as shown, voice coil 520 has its lower end 540 at position 541 and is positioned in a magnetic field in and around an air gap formed by magnetically permeable head plate 525 and pole piece 518 of the magnet assembly 521. The magnet assembly 521 is supported by basket 519, and includes casing 524, pole piece 518, magnet 522, magnetically permeable layer 523, magnetically permeable head plate 525, and top piece 526. In order to fully exploit the flexibility of the novel square surround 509, the magnet assembly 521 is sized, shaped, and arranged to permit the maximum upward excursion 542 and maximum downward excursion 544 of the former 506 and the voice coil 520. Preferably, excursions 542 and 544 are equal. In various alternate embodiments, excursions 542 and 544 may be slightly unequal. At the maximum upward excursion 542, the bottom 540 of voice coil 520 reaches position 543. At the maximum downward excursion 544, the bottom 540 of voice coil 520 reaches position 545.

Preferably, the components of square speaker 500 which have surfaces touching the air will have surface treatments that provide high thermal emissivity, such as black anodization for aluminum or E-coat for other metals. Attention to heat transfer out of the square speaker 500 is important, and radiant heat transfer from emissive surfaces assists in cooling the speaker 500.

For a particular ten-inch square speaker 500 with surround 509, the upper and lower excursions 542 and 544 are each 1.78 inches (a 78% improvement over the particular ten-inch KICKER L7) and the planar diaphragm area is 73.9 square inches (more than an 8% improvement over the particular ten-inch KICKER L7). The volume-displacement-to-speaker-size ratio of such speaker is 26.3, nearly double that of the particular ten-inch KICKER L7. For a particular twelve-inch square speaker 500 with surround 509, the upper and lower excursions 542 and 544 are 1.78 inches (a 78% improvement over the particular ten-inch KICKER L7) and the planar diaphragm area is 108.72 square inches (more than an 8% improvement over the particular twelve-inch KICKER L7). The volume-displacement-to-speaker-size ratio of such speaker 500 with surround 509 is 32.3, nearly double that of the particular twelve-inch KICKER L7. The implication of nearly doubling the volume-displacement-to-speaker-size ratio is that the volume of sound coming out of speaker 500 using square surround 509 or 100 is nearly double that of competing square speakers of similar size.

A ten-inch square speaker similar to speaker 500 but using the square surround 200 of FIG. 3 and having a magnet assembly 521 adapted to allow upward and downward excursions 542 and 544 of 1.3 inches (an improvement of 30% over the particular ten-inch KICKER L5) has a planar diaphragm area of 73.9 square inches (more than an 8% improvement over the particular ten-inch KICKER L5). The volume-displacement-to-speaker-size ratio of such speaker is 19.2, a 41% improvement over the particular ten-inch KICKER L5. A 12-inch square speaker 500 similar to speaker 500 but using the square surround 200 of FIG. 3 and having a magnet assembly 521 adapted to allow upward and downward excursions 542 and 544 of 1.3 inches (an improvement of 30% over the particular ten-inch KICKER L5) has a planar diaphragm area of 108.72 square inches (more than an 8% improvement over the particular 12-inch KICKER L5). The volume-displacement-to-speaker-size ratio of such speaker is 23.6, a 41% improvement over the particular 12-inch KICKER L5. With either the square speaker 500 using surround 509 (or 100) or a similarly adapted speaker using the square surround 200, there is a significant improvement in sound quantity indicative of novelty.

Figure 6:
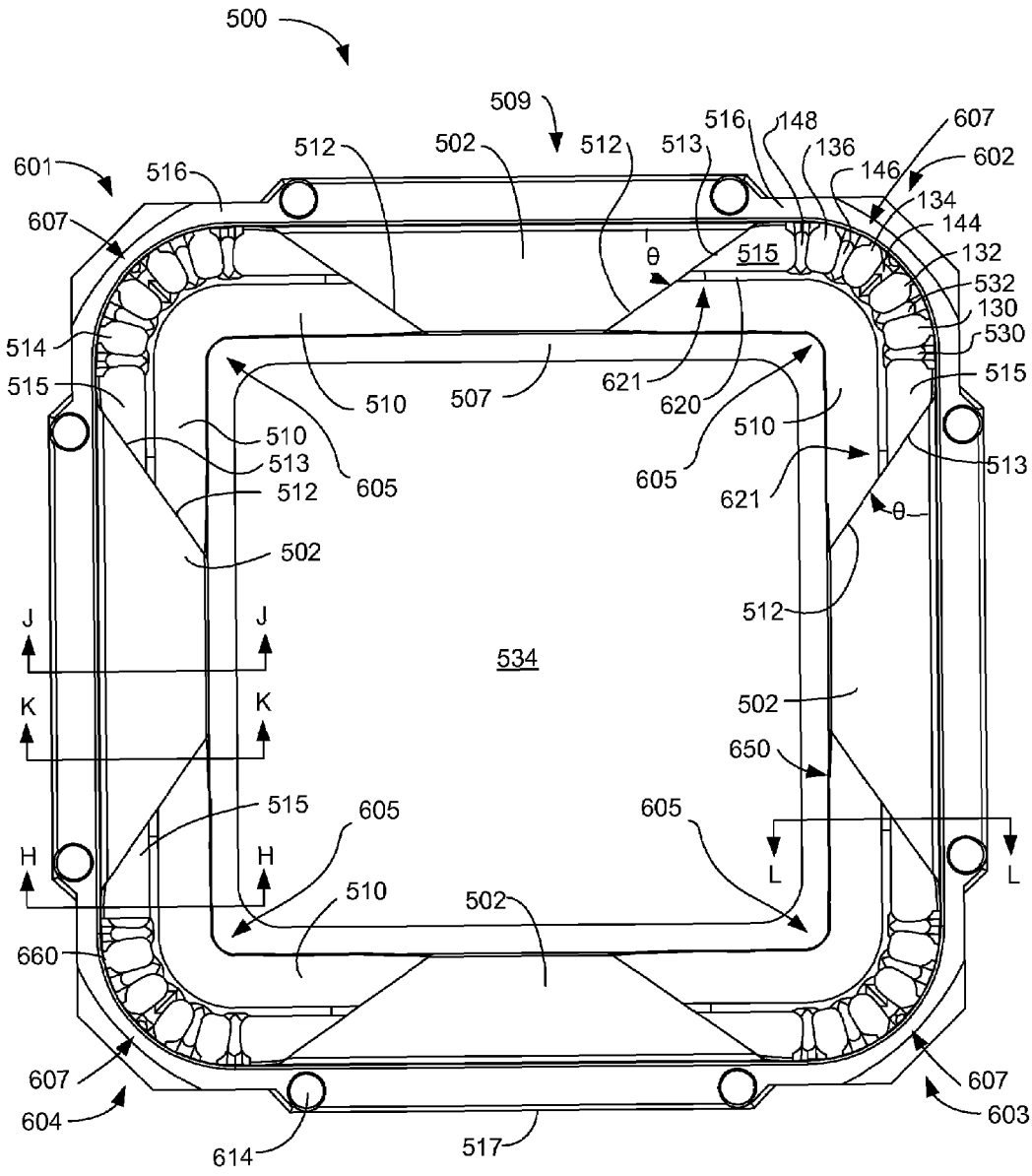
FIG. 6 shows a frontal plan view illustrating the exemplary embodiment of FIG. 1, according to a preferred embodiment of the present invention and defines sections H-H, J-J, K-K, and L-L.

FIG. 6 shows a frontal plan view illustrating the exemplary embodiment of FIG. 1, according to a preferred embodiment of the present invention and defines sections H-H, J-J, K-K, and L-L. Surround 509 is preferably a single molded piece with four straight sides 502 adjoining rounded corners 601, 602, 603, and 604, as well as an integral gasket 516 and an inner flange 507. It is a noteworthy novelty of the present invention that the rounded corners 601-604 take up most of the linear distance around the radially outer boundary 650 of inner flange 507. That is, each expansion pad 510 adjoins more than one-eighth of the radially outer boundary 650 of inner flange 507. Rounded corners 601-604 are bounded by preferably collinear edges 513 and 512 that extend at an angle θ from straight sides 502. Preferably, θ is approximately 35.15°±0.15°. In no case is θ greater than 40 degrees nor less than 20 degrees for square speakers of 10-inch and 12-inch sizes.

Using rounded corner 602 as exemplary, surround 509 has an extension pad 510 forming inner portion 605 and bounded by the inner flange 507, edges 512, and apex groove 620. Extension pad 510 tapers off toward the edges 512. Apex groove 620 has a constant depth, relative to extension pad 510, over the central portion of its length, and then tapers downward from points 621 to the top surfaces of straight sides 502. Apex groove 620 divides arcuate portion 660 of rounded corner 602 into an inner portion 605 and an outer portion 607. The inner portion 605 comprises extension pad 510. The outer portion 607 comprises the tapered protrusions 515 and a plurality of alternating depressions and protrusions, which will be discussed in more detail below. The rounded corner 602 also includes integral gasket 516. Tapered protrusions 515 taper toward the outer surface of straight sides 502 at edges 513.

The circumferentially arranged, radially symmetric depressions and protrusions are numbered first according to FIG. 5, for those referenced in that view, and then according to FIG. 1, for those not referenced in FIG. 5. Depression 530 is adjacent to tapered protrusion 515 and protrusion 130. Depression 532 joins protrusions 130 and 132. Protrusion 132 is continuous with central depression 144, which is the narrowest depression. Protrusion 134 is symmetrical with protrusion 132 about the central depression 144. Depression 146 joins protrusion 134 and is symmetrical about the central depression 144 with depression 532. Protrusion 136 is continuous with depression 146 and is symmetrical about the central depression 144 with protrusion 130. Depression 148 joins protrusion 136 and tapered protrusion 515 and is symmetrical about the central depression 144 with depression 530. Integral gasket 516 extends out to meet rim 517 and is adapted to be fastened with fasteners 614.

Section J-J is defined as a transverse cross-section through a straight side 502 and integral gasket 516. Section K-K is defined as a transverse cross-section through straight side 502, a small portion of expansion pad 510, and integral gasket 516. Section L-L is defined as a transverse cross-section through expansion pad 510, the tapered portion of groove 620, straight side 502, and integral gasket 516. Section H-H is defined as a transverse cross-section through expansion pad 510, groove 620, tapered protrusion 515, and integral gasket 516.

Figure 7:
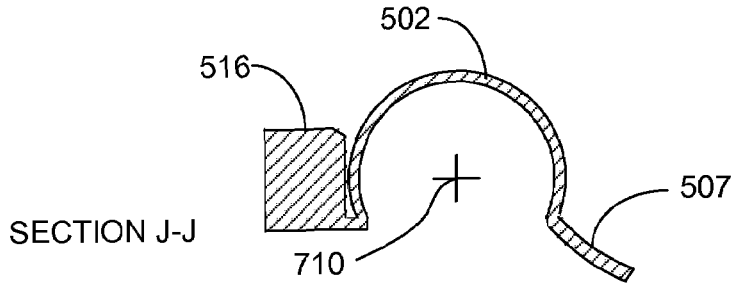
FIG. 7 shows a transverse cross-sectional view illustrating section J-J of FIG. 6, according to a preferred embodiment of the present invention.

FIG. 7 shows a transverse cross-sectional view illustrating section J-J of FIG. 6, according to a preferred embodiment of the present invention. Straight side 502 preferably has a uniformly semi-circular cross-section of uniform thickness. FIG. 7 shows the baseline configuration to which rounded corner 101, 201, and 601-604 configurations may be compared. Centerline 710, shown into the page in this view, may be used as a reference for radial extension there from. While centerline 710 is shown above the level of the bottom of integral gasket 516, the present invention is not so limited. In various alternate embodiments, centerline 710 may be lower or higher, or may be offset to either side.

Figure 8:
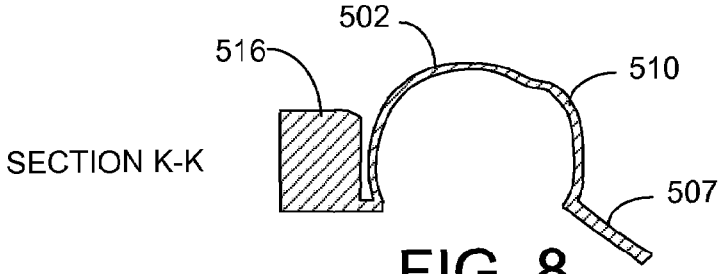
FIG. 8 shows a transverse cross-sectional view illustrating section K-K of FIG. 6, according to a preferred embodiment of the present invention.

FIG. 8 shows a transverse cross-sectional view illustrating section K-K of FIG. 6, according to a preferred embodiment of the present invention. A portion of extension pad 510 creates a variation from the baseline configuration of straight side 502.

Figure 9:
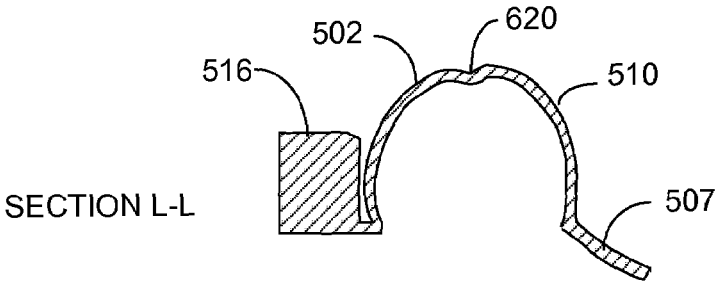
FIG. 9 shows a transverse cross-sectional view illustrating section L-L of FIG. 6, according to a preferred embodiment of the present invention.

FIG. 9 shows a transverse cross-sectional view illustrating section L-L of FIG. 6, according to a preferred embodiment of the present invention. Extension pad 510 is shown with greater radial extension and the tapered portion of apex groove 620 is noticeable.

Figure 10:
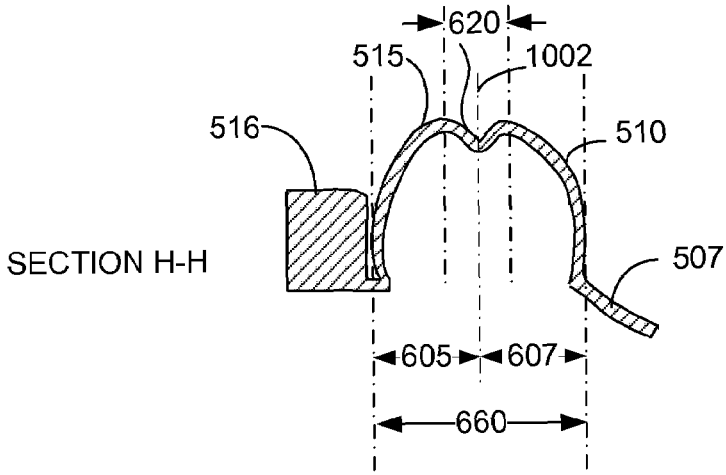
FIG. 10 shows a transverse cross-sectional view illustrating section H-H of FIG. 6, according to a preferred embodiment of the present invention.

FIG. 10 shows a transverse cross-sectional view illustrating section H-H of FIG. 6, according to a preferred embodiment of the present invention. Tapered protrusion 515 and extension pad 510 are at their maximum deviation from the baseline of straight side 502, and apex groove 620 is at its maximum depth. Vertical dashed lines are provided to show the boundaries defining apex groove 620 for purposes of description in this disclosure. Apex 1002 defines, by virtue of being a bisecting line, the boundaries of the apex groove 620 which, in turn, help define the boundaries of arcuate portion 660, inner portion 605, and outer portion 607, as shown.

Figure 11A:
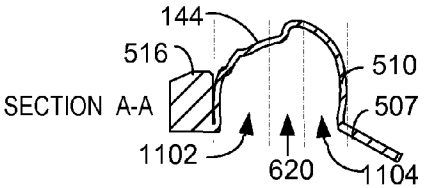
FIG. 11A shows a radial cross-sectional view illustrating section A-A of FIG. 1, according to a preferred embodiment of the present invention.
Figure 11B:
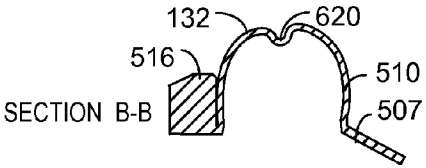
FIG. 11B shows a radial cross-sectional view illustrating section B-B of FIG. 1, according to a preferred embodiment of the present invention.
Figure 11C:
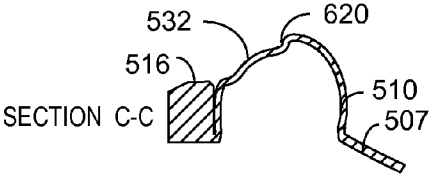
FIG. 11C shows a radial cross-sectional view illustrating section C-C of FIG. 1, according to a preferred embodiment of the present invention.
Figure 11D:
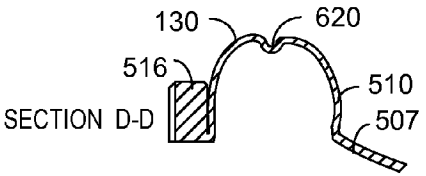
FIG. 11D shows a radial cross-sectional view illustrating section D-D of FIG. 1, according to a preferred embodiment of the present invention.
Figure 11E:
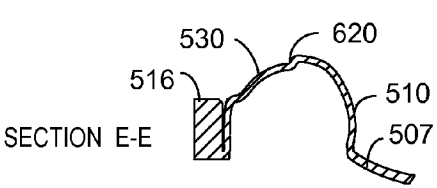
FIG. 11E shows a radial cross-sectional view illustrating section E-E of FIG. 1, according to a preferred embodiment of the present invention.
Figure 11F:
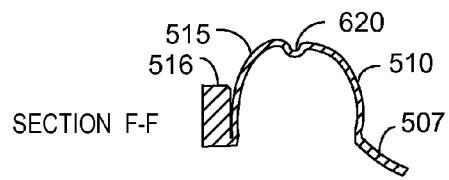
FIG. 11F shows a transverse cross-sectional view illustrating section F-F of FIG. 1, according to a preferred embodiment of the present invention.
Figure 11:
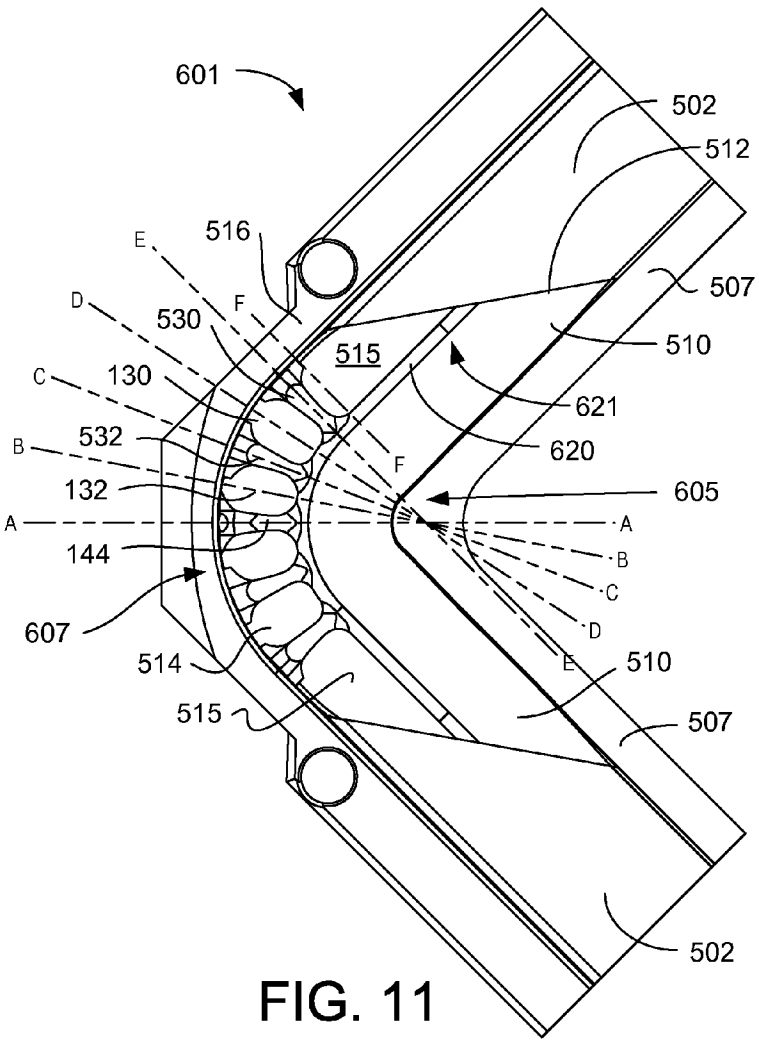
FIG. 11 shows a top plan view illustrating the rounded corner of the exemplary embodiment of FIG. 1, and defining radial cross-sections A-A, B-B, C-C, D-D, and E-E, and transverse cross-section F-F, according to a preferred embodiment of the present invention.

FIG. 11 shows a top plan view illustrating the rounded corner 602 of the exemplary embodiment of FIG. 1 and FIG. 6, and defining radial cross-sections A-A, B-B, C-C, D-D, and E-E, and transverse cross-section F-F, according to a preferred embodiment of the present invention. The numbering of features in rounded corner 602 follows FIG. 6. Radial cross-section A-A is through the central depression 144 along the line of radial symmetry for rounded corner 602. Radial cross-section B-B is through the protrusion 132 along the midline of the protrusion 132. Radial cross-section C-C is through the depression 532 along the midline of the depression 532. Radial cross-section D-D is through the protrusion 130 along the midline of the protrusion 130. Radial cross-section E-E is through the depression 530 along the midline of the depression 530. Transverse cross-section F-F is through extension pad 510 and tapered protrusion 515.

FIG. 11A shows a radial cross-sectional view illustrating section A-A of FIG. 11, according to a preferred embodiment of the present invention. Radial cross-section A-A is through the central depression 144 along the line of radial symmetry for rounded corner 602. Central depression 144 locally collapses one side of apex groove 620. Extension pad 510 is shown at the maximum extension away from the baseline surface of straight side 502.

FIG. 11B shows a radial cross-sectional view illustrating section BB of FIG. 11, according to a preferred embodiment of the present invention. Radial cross-section B-B is through the protrusion 132 along the midline of the protrusion 132. The extension of protrusion 132 is approximately the same as the extension of extension pad 510, and apex groove 620 is shown at maximum depth.

FIG. 11C shows a radial cross-sectional view illustrating section C-C of FIG. 11, according to a preferred embodiment of the present invention. Radial cross-section C-C is through the depression 532 along the midline of the depression 532. Depression 532 is shown to also locally collapse one side of apex groove 620. Depression 532 intrudes into the concave side of the arcuate surround less than depression 144, as shown. As with all the cross sections defined in FIG. 11, the exact size and shape of the cross-section of integral gasket 516 may vary to fit rims 517 of various designs.

FIG. 11D shows a radial cross-sectional view illustrating section D-D of FIG. 11, according to a preferred embodiment of the present invention. Radial cross-section D-D is through the protrusion 130 along the midline of the protrusion 130. Extension pad 510 is slightly higher here than opposite neighboring protrusion 132.

FIG. 11E shows a radial cross-sectional view illustrating section E-E of FIG. 11, according to a preferred embodiment of the present invention. Radial cross-section E-E is through the depression 530 along the midline of the depression 530. Cross-section E-E is substantially the same as cross-section C-C.

FIG. 11F shows a transverse cross-sectional view illustrating section F-F of FIG. 11, according to a preferred embodiment of the present invention. Transverse cross-section F-F is through extension pad 510 and tapered protrusion 515 at its highest point. Extension pad 510 has substantially the same cross-section as in section E-E.

Figures 12, 12A, 12B, 12C, 12D, 12E, 12F:
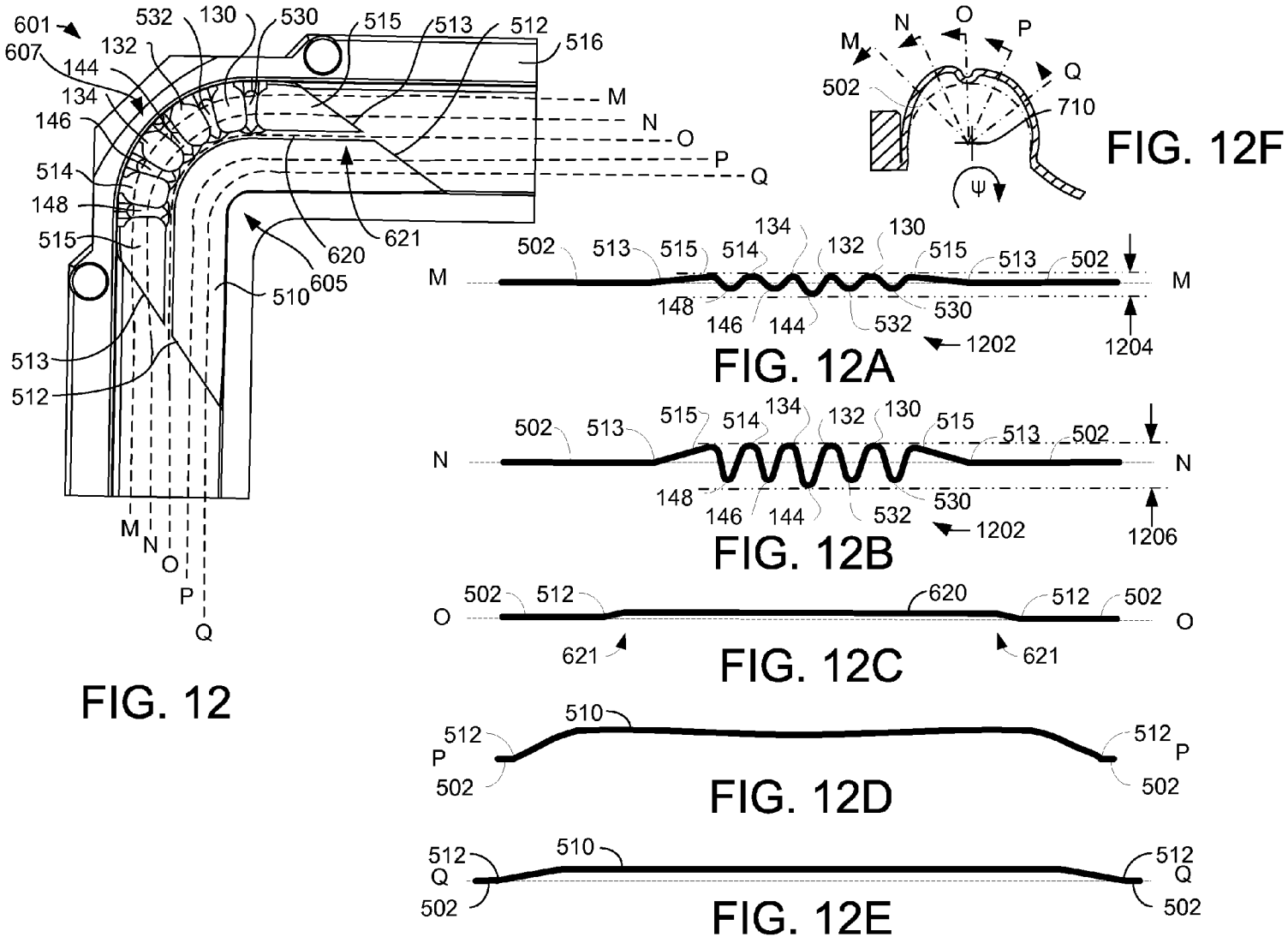
FIG. 12 shows the top plan view of FIG. 11 partially illustrating the rounded corner of the exemplary embodiment of FIG. 1, and defining circumferential cross-sections M-M, N-N, O-O, P-P, and Q-Q, according to a preferred embodiment of the present invention.
FIG. 12A shows a circumferential cross-sectional view illustrating section M-M of FIG. 12, according to a preferred embodiment of the present invention.
FIG. 12B shows a circumferential cross-sectional view illustrating section N-N of FIG. 12, according to a preferred embodiment of the present invention.
FIG. 12C shows a circumferential cross-sectional view illustrating section O-O of FIG. 12, according to a preferred embodiment of the present invention.
FIG. 12D shows a circumferential cross-sectional view illustrating section P-P of FIG. 12, according to a preferred embodiment of the present invention.
FIG. 12E shows a circumferential cross-sectional view illustrating section Q-Q of FIG. 12, according to a preferred embodiment of the present invention.
FIG. 12F shows a cross-sectional view partially illustrating the exemplary embodiment of FIG. 1 and further defining sections M-M through Q-Q in FIG. 12, according to a preferred embodiment of the present invention.

FIG. 12 shows the top plan view of FIG. 11 partially illustrating the rounded corner 601 of the exemplary embodiment of FIG. 6, and defining circumferential cross-sections M-M, N-N, O-O, P-P, and Q-Q, according to a preferred embodiment of the present invention. The plains of cross-sections M-M, N-N, O-O, P-P, and Q-Q are further clarified in FIG. 12F against a cross-section F-F from FIG. 11. Apex groove 620 divides the rounded corner 601 into an outer portion 607 and an inner portion 605. Section M-M is circumferential through the outer portion 607 of rounded corner 601, more proximate the integral gasket 516 than not, and radial to the centerline 710 (see FIG. 12F) of the cross-section of straight side 502. Section N-N is circumferential through the outer portion 607 of rounded corner 601, more distal the integral gasket 516 than not, and radial to the centerline 710 of the cross-section of straight side 502. Section O-O is circumferential through the apex groove 620 and radial to the centerline 710 of the cross-section of straight side 502. Section P-P is circumferential through the inner portion 605 of rounded corner 601, more distal the inner flange 507 than not, and radial to the centerline 710 of the cross-section of straight side 502. Section Q-Q is circumferential through the inner portion 605 of rounded corner 601, more proximate the inner flange 507 than not, and radial to the centerline 710 of the cross-section of straight side 502.

FIG. 12A shows a straightened-out circumferential cross-sectional view illustrating section M-M of FIG. 12, according to a preferred embodiment of the present invention. Section M-M is circumferential through the outer portion 607 of rounded corner 601, more proximate the integral gasket 516 than not, and radial to the centerline 710 of the cross-section of straight side 502. The dashed horizontal line in FIG. 12A indicates the level of straight side 502. The circumferential undulations 1202 are preferably trapezoidal circumferential undulations and more preferably smoothed trapezoidal circumferential undulations 1202 created by protrusions 515, 130, 132, 134, and 515 and by depressions 530, 532, 144, 146, and 148 on the outer portion 607 of exemplary rounded corner 601, as shown in FIG. 12A and FIG. 12B. The circumferential undulations 1202 have an amplitude 1204 that increases with proximity to the apex groove 620. While smoothed trapezoidal circumferential undulations 1202 are preferred, slight variations in the cross-section shape of the smoothed trapezoidal circumferential undulations 1202 may suffice in some alternate embodiments. For example, in various alternate embodiments, variation toward sinusoidal undulations or square undulations may produce useful effects. The amplitude 1204 of the individual undulations is preferably non-uniform but symmetric about central depression 144. Each undulation may have a unique amplitude. For example, depression 144 is preferably deeper than depressions 148, 146, 532, or 530, which can be more easily seen in FIG. 12B. Tapered protrusions 515 taper down to edges 513 and merge with proximal straight sides 502.

FIG. 12B shows a circumferential cross-sectional view illustrating section N-N of FIG. 12, according to a preferred embodiment of the present invention. Section N-N is circumferential through the outer portion 607 of rounded corner 601, more distal the integral gasket 516 than not, and radial to the centerline 710 of the cross-section of straight side 502. Smoothed circumferential trapezoidal undulations 1202 show greater amplitude 1206 of undulation than in section M-M. Preferably, the amplitude 1204 and 1206 of circumferential undulations 1202 increases with the angle ψ (See FIG. 12F) from the initial low point of depression 144 to proximate the apex groove 620.

FIG. 12C shows a circumferential cross-sectional view illustrating section O-O of FIG. 12, according to a preferred embodiment of the present invention. Section O-O is circumferential through the apex groove 620 and radial to the centerline 710 of the cross-section of straight side 502. The main portion of the apex groove 620 is just above the baseline of the surface of the straight side 502 (See FIG. 12 F), and tapers down to meet the surface of straight side 502 starting at points 621 and ending at edges 512.

FIG. 12D shows a circumferential cross-sectional view illustrating section P-P of FIG. 12, according to a preferred embodiment of the present invention. Section P-P is circumferential through the inner portion 605 of corner 601, more distal the inner flange 507 than not, and radial to the centerline 710 of the cross-section of straight side 502. Section P-P cuts extension pad 510, which lowers slightly in the center to bend around the inside of corner 601. Extension pad 510 extends further, distal from the center of corner 601, and then declines smoothly to edges 512 and the straight sides 502.

FIG. 12E shows a circumferential cross-sectional view illustrating section Q-Q of FIG. 12, according to a preferred embodiment of the present invention. Section Q-Q is circumferential through the inner portion 605 of corner 601, more proximate the inner flange 507 than not, and radial to the centerline 710 of the cross-section of straight side 502. Section Q-Q cuts extension pad 510 at a circumference when its extension away from the baseline level of straight side 502 is less than in section P-P.

FIG. 12F shows a cross-sectional view partially illustrating the exemplary embodiment of FIG. 1 and further defining sections M-M through Q-Q in FIG. 12, according to a preferred embodiment of the present invention. Angle ψ is defined to emphasize that protrusions increase in amplitude 1204 and 1206 with ψ and the extension pad 510 decreases in amplitude with ψ. The arrowheads in FIG. 12 F provide information necessary to understanding the curved planes of circumferential cross-sectional lines in FIG. 12. Centerline 710, shown into the page in this view, is the centerline 710 of curvature of the transverse cross-section of straight side 502 (See FIG. 7), as shown in dashed line.

Figure 13A:
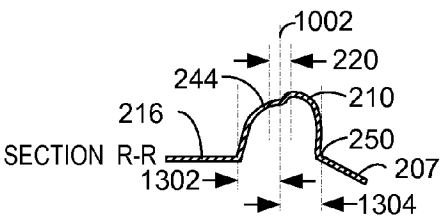
FIG. 13A shows a radial cross-sectional view illustrating section R-R of FIG. 13, according to a preferred embodiment of the present invention.
Figure 13B:
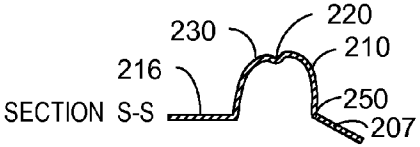
FIG. 13B shows a radial cross-sectional view illustrating section S-S of FIG. 13, according to a preferred embodiment of the present invention.
Figure 13C:
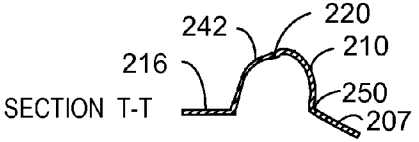
FIG. 13C shows a radial cross-sectional view illustrating section T-T of FIG. 13, according to a preferred embodiment of the present invention.
Figure 13D:
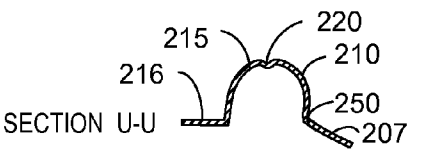
FIG. 13D shows a radial cross-sectional view illustrating section U-U of FIG. 13, according to a preferred embodiment of the present invention.
Figure 13:
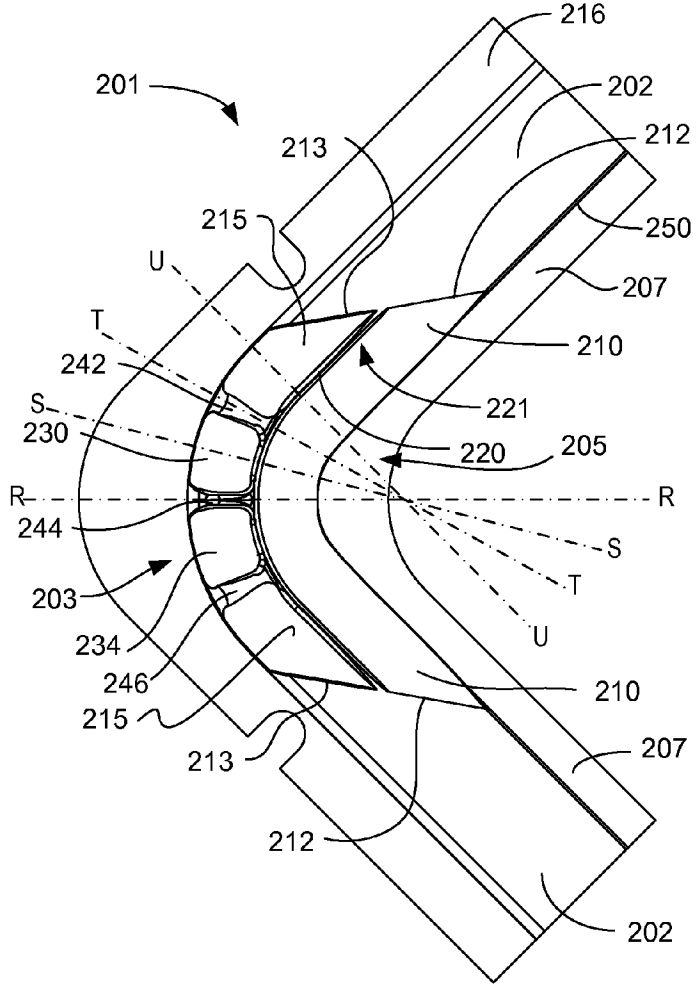
FIG. 13 shows a top plan view illustrating the rounded corner of the exemplary embodiment of FIG. 3, and defining radial cross-sections R-R, S-S, T-T, and U-U, according to a preferred embodiment of the present invention.

FIG. 13 shows a top plan view illustrating the rounded corner 201 of the exemplary embodiment of FIG. 3, and defining radial cross-sections R-R, S-S, T-T, and U-U, according to a preferred embodiment of the present invention. Radial cross-section R-R is through the central depression 244 along the line of radial symmetry for rounded corner 201. Radial cross-section S-S is through the protrusion 230 along the midline of the protrusion 230. Radial cross-section T-T is through the depression 242 along the midline of the depression 242. Radial cross-section U-U is through the tapered protrusion 215.

FIG. 13A shows a radial cross-sectional view illustrating section R-R of FIG. 13, according to a preferred embodiment of the present invention. Radial cross-section R-R is through the central depression 244 along the line of radial symmetry for rounded corner 201. Depression 244 locally collapses the proximal side of apex groove 220. Extension pad 210 is significantly radially extended between the apex groove 220 and the outer boundary 250 of inner flange 207, with the extension increasing with proximity to apex groove 220. Outer flange 216 may receive a discrete gasket, as an alternative to the preferred integral gasket 516 (See FIG. 5).

FIG. 13B shows a radial cross-sectional view illustrating section S-S of FIG. 13, according to a preferred embodiment of the present invention. Radial cross-section S-S is through the protrusion 230 along the midline of the protrusion 230. Protrusion 230 is wider than the protrusions 130 or 132 of FIG. 11, and begins lower on the outer portion 203 of rounded corner 201. Protrusion 230 assists in forming apex groove 220, as does extension pad 210.

FIG. 13C shows a radial cross-sectional view illustrating section T-T of FIG. 13, according to a preferred embodiment of the present invention. Radial cross-section T-T is through the depression 242 along the midline of the depression 242. Depression 242 intrudes into the concave cross-section of the arcuate rounded corner 201. Depression 242 locally collapses the proximal side of apex groove 220.

FIG. 13D shows a radial cross-sectional view illustrating section U-U of FIG. 13, according to a preferred embodiment of the present invention. Radial cross-section U-U is through the tapered protrusion 215. Extension pad 210 and tapered protrusion 215 assist in forming apex groove 220.

Figures 14, 14A, 14B, 14C, 14D, 14E, 14F:
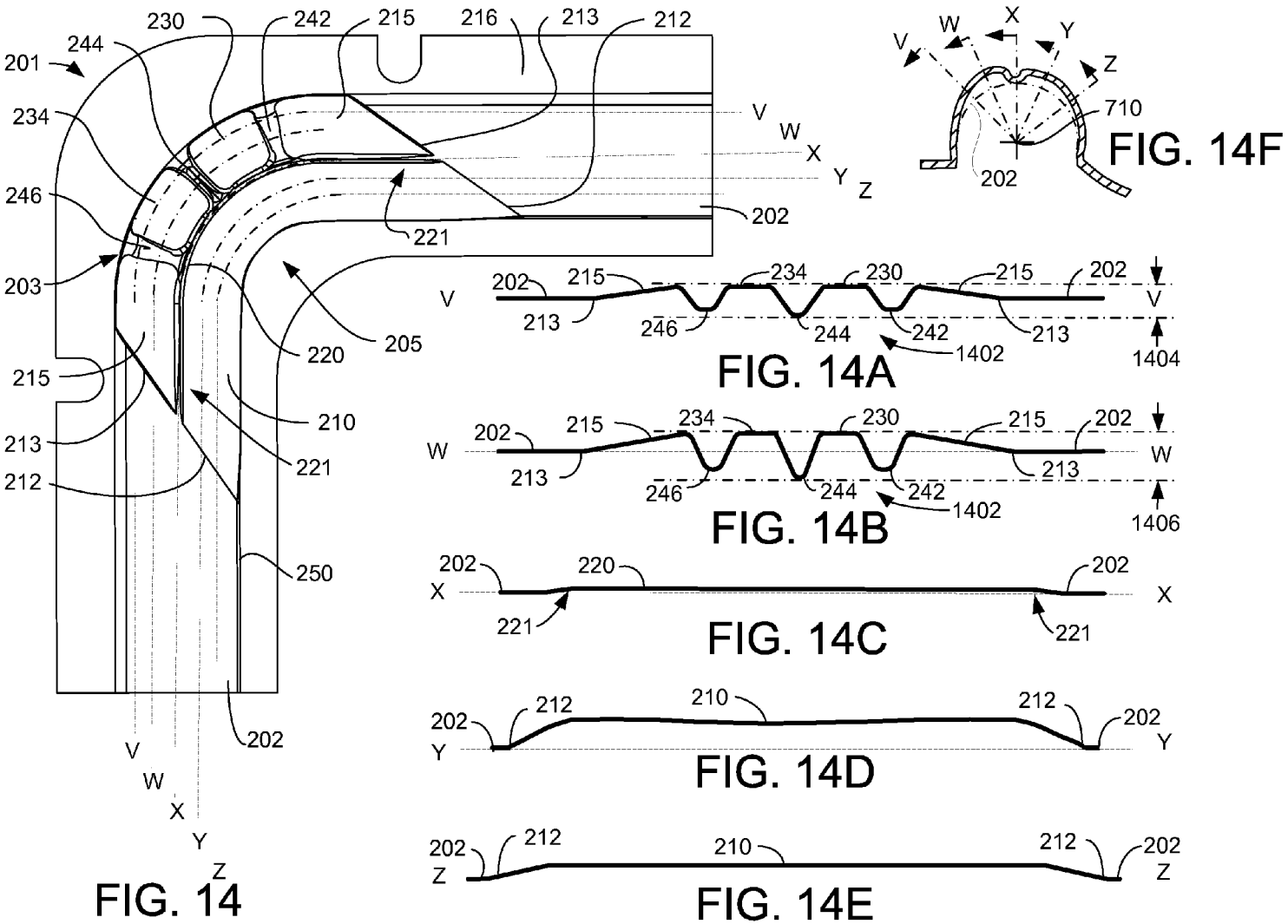
FIG. 14 shows the top plan view of FIG. 13 partially illustrating the rounded corner of the exemplary embodiment of FIG. 3, and defining circumferential cross-sections V-V, W-W, X-X, Y-Y, and Z-Z, according to a preferred embodiment of the present invention.
FIG. 14A shows a circumferential cross-sectional view illustrating section V-V of FIG. 14, according to a preferred embodiment of the present invention.
FIG. 14B shows a circumferential cross-sectional view illustrating section W-W of FIG. 14, according to a preferred embodiment of the present invention.
FIG. 14C shows a circumferential cross-sectional view illustrating section X-X of FIG. 14, according to a preferred embodiment of the present invention.
FIG. 14D shows a circumferential cross-sectional view illustrating section Y-Y of FIG. 14, according to a preferred embodiment of the present invention.
FIG. 14E shows a circumferential cross-sectional view illustrating section Z-Z of FIG. 14, according to a preferred embodiment of the present invention.
FIG. 14F shows a cross-sectional view partially illustrating the exemplary embodiment of FIG. 1 and further defining sections V-V through Z-Z in FIG. 14, according to a preferred embodiment of the present invention.

FIG. 14 shows the top plan view of FIG. 13 partially illustrating the rounded corner 201 of the exemplary embodiment of FIG. 3, and defining circumferential cross-sections V-V, W-W, X-X, Y-Y, and Z-Z, according to a preferred embodiment of the present invention. The plains of cross-sections V-V, W-W, X-X, Y-Y, and Z-Z are further clarified in FIG. 14F against a cross-section U-U from FIG. 13. Apex groove 220 divides the rounded corner 201 into an outer portion 203 and an inner portion 205. Section V-V is circumferential through the outer portion 203 of rounded corner 201, more proximate the outer flange 216 than not, and radial to the centerline 710 of the cross-section of straight side 202. Section W-W is circumferential through the outer portion 203 of rounded corner 201, more distal outer flange 216 than not, and radial to the centerline 710 of the cross-section of straight side 202. Section X-X is circumferential through the apex groove 220 and radial to the centerline 710 of the cross-section of straight side 202. Section Y-Y is circumferential through the inner portion 205 of rounded corner 201, more distal the inner flange 207 than not, and radial to the centerline 710 of the cross-section of straight side 202. Section Z-Z is circumferential through the inner portion 205 of rounded corner 201, more proximate the inner flange 207 than not, and radial to the centerline 710 of the cross-section of straight side 202.

FIG. 14A shows a circumferential cross-sectional view illustrating section V-V of FIG. 14, according to a preferred embodiment of the present invention. Section V-V is circumferential through the outer portion 203 of rounded corner 201, more proximate the outer flange 216 than not, and radial to the centerline 710 of the cross-section of straight side 202. The dashed horizontal line in FIG. 14A indicates the level of straight side 202. The circumferential trapezoidal undulations 1402 created by tapered protrusions 215 and protrusions 230 and 234, and by depressions 246, 244, and 242 on the outer portion 203 of exemplary rounded corner 201 can be seen in FIG. 14A. While circumferential trapezoidal undulations 1402 are preferably smoothed, slight variations in the cross-section shape of the smoothed trapezoidal circumferential undulations 1402 may suffice in some alternate embodiments. For example, in various alternate embodiments, variation toward sinusoidal undulations or square undulations may produce useful effects. A more square circumferential undulation could provide more material for circumferential expansion, whereas a more sinusoidal undulation may provide a more rapid response. The amplitude 1404 of the smoothed trapezoidal circumferential undulations 1402 is preferably non-uniform but symmetric about central depression 244. Each undulation may have a unique amplitude 1404. For example, depression 244 is preferably deeper than depressions 242 or 246, which can be more easily seen in FIG. 14B. Tapered protrusions 215 taper down to edges 213 and merge with arcuate surround straight sides 202.

FIG. 14B shows a circumferential cross-sectional view illustrating section W-W of FIG. 14, according to a preferred embodiment of the present invention. Section W-W is circumferential through the outer portion 203 of rounded corner 201, more distal outer flange 216 than not, and radial to the centerline 710 of the cross-section of straight side 202. Smoothed circumferential trapezoidal undulations 1402 show greater amplitude 1406 of undulation than in section V-V. Preferably, the amplitude 1406 of undulation increases with ψ (See FIG. 14F) from proximate the outer flange 216 to proximate the apex groove 220. Accordingly, the amplitude 1406 of smoothed trapezoidal circumferential undulations 1402 increases with proximity to the apex groove 220.

FIG. 14C shows a circumferential cross-sectional view illustrating section X-X of FIG. 14, according to a preferred embodiment of the present invention. Section X-X is circumferential through the apex groove 220 and radial to the centerline 710 of the cross-section of straight side 202. The main portion of the groove 220 is just above the baseline of the surface of the straight side 202 (See FIG. 14 F), and tapers down to meet the surface of straight side 202 starting at points 221 and ending at edges 212.

FIG. 14D shows a circumferential cross-sectional view illustrating section Y-Y of FIG. 14, according to a preferred embodiment of the present invention. Section Y-Y is circumferential through the inner portion 205 of rounded corner 201, more distal the inner flange 207 than not, and radial to the centerline 710 of the cross-section of straight side 202. Section Y-Y cuts extension pad 210, which lowers slightly in the center to bend around the inside of rounded corner 201. It extends further, distal from the center of rounded corner 201, and then declines smoothly to edges 212 and the straight sides 202.

FIG. 14E shows a circumferential cross-sectional view illustrating section Z-Z of FIG. 14, according to a preferred embodiment of the present invention. Section Z-Z is circumferential through the inner portion 205 of rounded corner 201, more proximate the inner flange 207 than not, and radial to the centerline 710 of the cross-section of straight side 202. Section Z-Z cuts extension pad 210 at a circumference where its extension away from the baseline level of straight side 202 is less than in section Y-Y.

FIG. 14F shows a cross-sectional view partially illustrating the exemplary embodiment of FIG. 1 and further defining sections VV through ZZ in FIG. 14, according to a preferred embodiment of the present invention. Angle ψ is defined to emphasize that protrusions increase in amplitude 1404 with ψ and the extension pad 210 decreases in amplitude with ψ. The arrowheads in FIG. 14 F provide information necessary to understanding the curved planes of circumferential cross-sectional lines in FIG. 14, indicated by broken lines. Centerline 710, shown into the page in this view, is the centerline 710 of curvature of the transverse cross-section of straight side 202 (See FIG. 7), as shown in dashed line.

Figure 15:
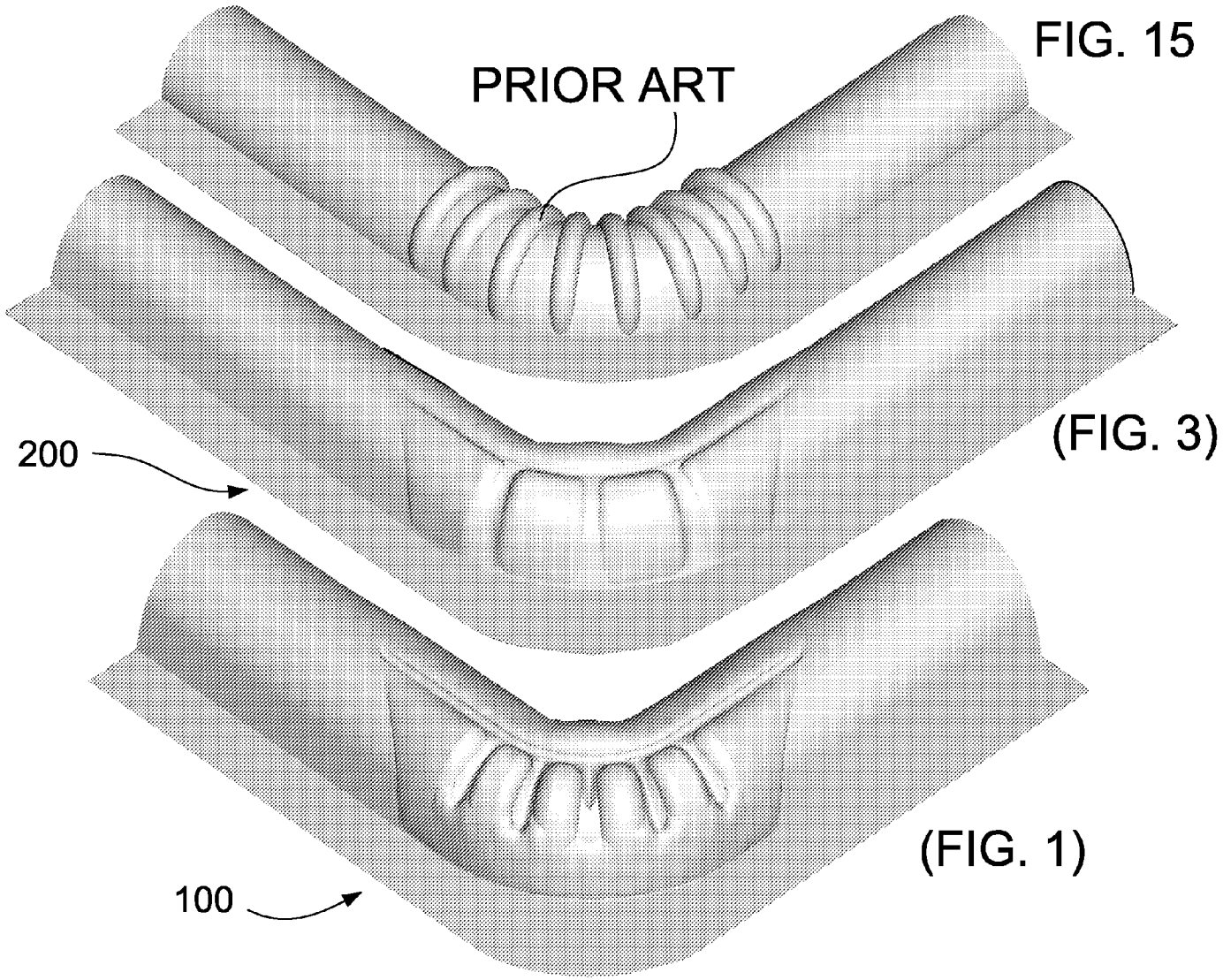
FIG. 15 PRIOR ART
FIG. 15 shows a rendered perspective view from outside a square surround rounded corner illustrating a corner portion of a KICKER, similar to the prior art of Irby et al., (U.S. Pat. No. 6,611,604) for comparison with the first and second embodiments of FIG. 1 and FIG. 3, respectively.

FIG. 15 shows a rendered perspective view from outside a square surround corner partially illustrating prior art (the KICKER, mentioned above) similar to Irby et al., (U.S. Pat. No. 6,611,604) for comparison with the first and second embodiments of FIG. 1 and FIG. 3, respectively.

Figure 16:
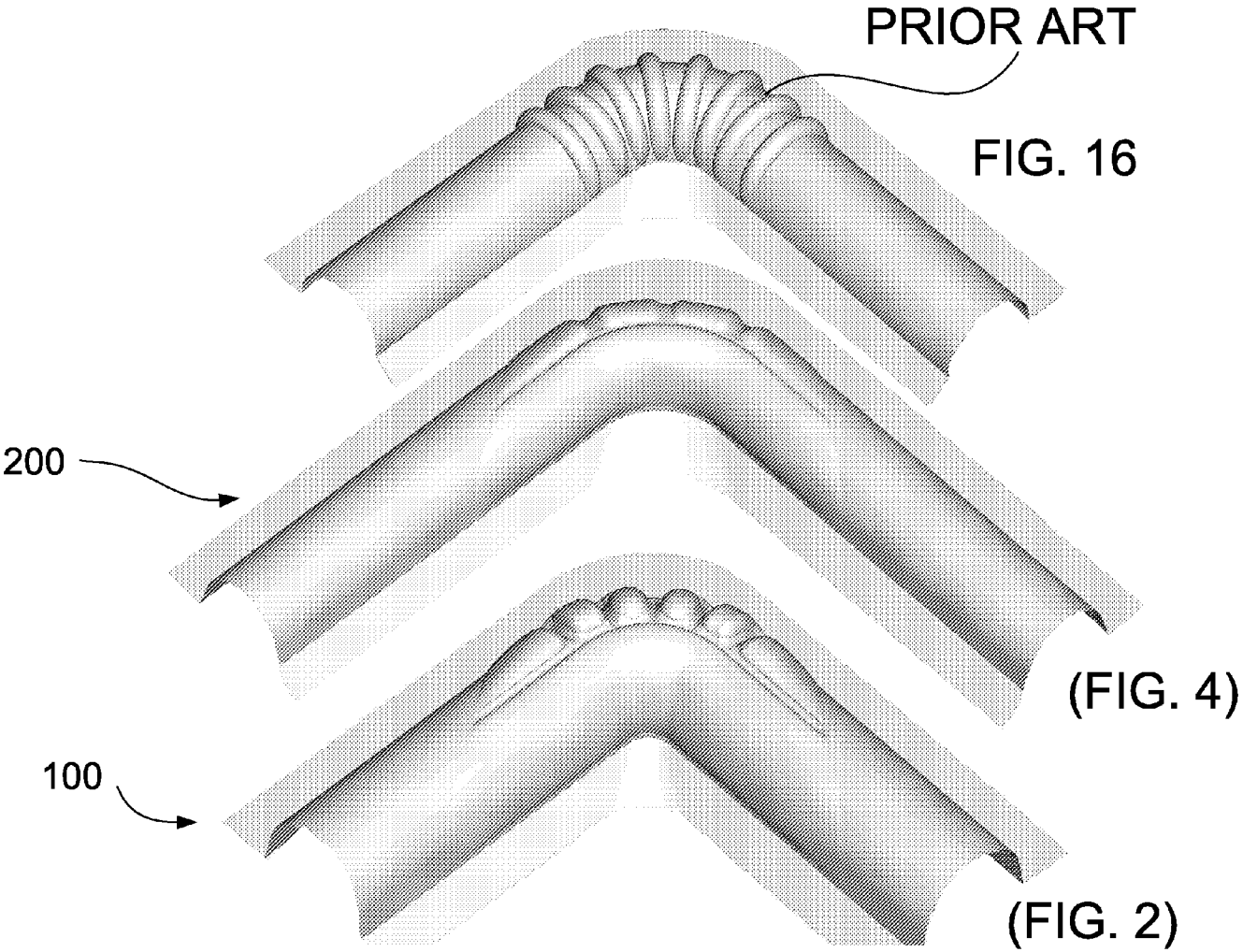
PRIOR ART FIG. 16
FIG. 16 shows a rendered perspective view from inside a square surround rounded corner illustrating a corner portion of a KICKER, similar to the prior art of Irby et al., (U.S. Pat. No. 6,611,604) for comparison with the first and second embodiments of FIG. 2 and FIG. 4, respectively.

FIG. 16 shows a rendered perspective view from inside a square surround corner partially illustrating prior art (the KICKER, mentioned above) similar to Irby et al., (U.S. Pat. No. 6,611,604) for comparison with the first and second embodiments of FIG. 1 and FIG. 3, respectively.

Although applicant has described applicant's preferred embodiments of this invention, it will be understood that the broadest scope of this invention includes modifications such as diverse shapes, sizes, and materials. For example, and without limitation, the teachings of this disclosure may be applied to polygonal speakers of all shapes. Such scope is limited only by the below claims as read in connection with the above specification. Further, many other advantages of applicant's invention will be apparent to those skilled in the art from the above descriptions and the below claims.

What is claimed is:

1. A square speaker comprising:

a. an arcuate portion of a rounded corner of a square surround, said arcuate portion comprising a radially inner portion and a radially outer portion;

b. an apex defining a boundary between said inner portion and said outer portion;

c. circumferential undulations of said outer portion; and d. said arcuate portion further comprising an extension pad forming said inner portion.

2. The square speaker of claim 1, wherein said circumferential undulations comprise smoothed trapezoidal circumferential undulations.

3. The square speaker of claim 1, wherein said square surround comprises a straight side adjoining said rounded corner, said rounded corner further comprising a tapered protrusion on said outer portion, wherein said tapered protrusion comprises an edge, said edge making an angle of between 20° and 40° with said straight side.

4. The square speaker of claim 1, wherein said square surround comprises a straight side adjoining said rounded corner and further comprises an inner flange for adhering to a diaphragm, said rounded corner further comprising an extension pad forming said inner portion, wherein said extension pad has an edge, said edge making an angle of between 20° and 40° with said straight side, and further wherein said extension pad adjoins more than one-eighth of a radially outward boundary of said inner flange.

5. The square speaker of claim 1, further comprising an apex groove along said apex.

6. The square speaker of claim 1, further comprising a gasket integral to said square surround.

7. The square speaker of claim 1, further comprising a magnet assembly and a former, wherein said magnet assembly is sized, shaped, and arranged to allow upward and downward excursions of said former, said excursions having a magnitude sized to exploit the flexibility of said square surround.

8. A square speaker, comprising:

a. a square surround comprising straight sides adjoining rounded corners, each rounded corner of said rounded corners comprising an inner flange, an outer flange, and an arcuate portion between said inner flange and said outer flange, said arcuate portion comprising a radially inner portion and a radially outer portion;

b. an apex defining a boundary between said inner portion and said outer portion;

c. an apex groove along said apex; and d. said arcuate portion further comprising an extension pad forming said inner portion, wherein said extension pad comprises edges making angles of between 20° and 40° with said straight sides.

9. The square speaker of claim 8, wherein said angles are between 35 degrees 35.3 degrees.

10. The square speaker of claim 8, wherein a. said inner flange comprises a radially outward boundary; and b. said at least one extension pad adjoins more than one-eighth of said radially outward boundary of said inner flange.

11. The square speaker of claim 8, further comprising circumferential undulations of said outer portion.

12. The square speaker of claim 11, wherein said circumferential undulations comprise trapezoidal circumferential undulations.

13. The square speaker of claim 11, wherein said circumferential undulations comprise smoothed trapezoidal circumferential undulations.

14. The square speaker of claim 11, wherein said circumferential undulations increase in amplitude with proximity to said apex groove.

15. The square speaker of claim 11, further comprising at least one tapered protrusion on said at least one outer portion, said at least one tapered protrusion having an edge making an angle of less than 40 degrees and greater than 20 degrees with a proximal straight side of said straight sides.

16. The square speaker of claim 8, further comprising a. a rim for receiving said square surround;

b. a gasket for securing said square surround on said rim, wherein said gasket is one of integral to said square surround and discrete;

c. a basket supporting said rim;

d. a square diaphragm attached to said square surround;

e. a sub-cone fixed to the underside of said square diaphragm;

f. a former fixed to said sub-cone and supported by a spider that is supported by said basket, wherein said spider flexibly supports said former with the assistance of a collar; and g. a voice coil fixed to said former, wherein said voice coil is positioned in a magnetic field, said magnetic field formed by a magnet assembly supported by said basket, wherein said magnet assembly is sized, shaped, and arranged to allow upward and downward excursions of said former exploitive of said square surround.

17. The square speaker of claim 8, wherein said at least one square surround comprises at least one integral gasket.

18. A square speaker comprising:

a. a rounded corner on a square surround, said rounded corner having a radially inner portion comprising an arcuate transverse cross-section and a radially outer portion comprising an arcuate transverse cross-section;

b. an apex groove defining a boundary between said inner portion and said outer portion;

c. smoothed trapezoidal circumferential undulations of said outer portion, comprising a sequence of protrusions and depressions, wherein said undulations have an amplitude and said amplitude increases with proximity to said apex groove;

d. a pair of tapered protrusions on said outer portion flanking said smoothed trapezoidal circumferential undulations;

e. straight sides adjoining said rounded corner, said straight sides having an arcuate transverse cross-section defining a centerline;

f an extension pad forming said inner portion, wherein said extension pad extends radially outward, relative to said centerline, increasingly with proximity to said apex groove;

g. an inner flange, operable to be adhered to a diaphragm, having a radially outward boundary along said straight sides and said rounded corner; and h. edges between said rounded corner and said straight sides of said square surround, wherein said edges make angles of between 20 degrees and 40 degrees with proximal said straight sides, said edges forming edges of said expansion pad and forming edges of said tapered protrusions, and further wherein said extension pad adjoins more than one-eighth of said radially outward boundary of said inner flange.

19. The square speaker of claim 18, further comprising:

a. a rim for receiving said square surround;

b. a gasket for securing said square surround on said rim, wherein said gasket is one of integral to said square surround and discrete;

c. a basket supporting said rim;

d. a square diaphragm attached to said square surround;

e. a sub-cone fixed to the underside of said square diaphragm;

f. a former fixed to said sub-cone and flexibly supported by a spider that is supported by said basket, wherein said spider supports said former with the assistance of a collar; and g. a voice coil fixed to said former, wherein said voice coil is positioned in a magnetic field, said magnetic field formed by a magnet assembly supported by said basket, wherein said magnet assembly is sized, shaped, and arranged to allow upward and downward excursions of said former exploitive of said square surround.

20. The square speaker of claim 18, wherein said protrusions and said depressions of said smoothed trapezoidal circumferential undulations individually have unequal amplitudes.

* * * * *